US006082557A

United States Patent [19]

Leahy

[11] Patent Number: 6,082,557

[45] Date of Patent: Jul. 4, 2000

[54] SHELVING SYSTEM

[75] Inventor: John Leahy, Keysborough, Australia

[73] Assignee: Checkmate International Pty. Ltd., Victoria, Australia

[21] Appl. No.: 09/051,421

[22] PCT Filed: Oct. 17, 1996

[86] PCT No.: PCT/AU96/00654

§ 371 Date: Apr. 10, 1998

§ 102(e) Date: Apr. 10, 1998

[87] PCT Pub. No.: WO97/14334

PCT Pub. Date: Apr. 24, 1997

[30] Foreign Application Priority Data

Oct. 17, 1995 [AU] Australia ..... PN5976
Aug. 27, 1996 [AU] Australia ..... PO1885

[51] Int. Cl.[7] ..... A47F 5/00

[52] U.S. Cl. ..... 211/59.3; 211/59.2; 211/90.02; 211/184

[58] Field of Search ..... 211/59.2, 59.3, 211/90.01, 90.02, 184, 175

[56] References Cited

U.S. PATENT DOCUMENTS

| | | | |
|---|---|---|---|
| Re. 30,706 | 8/1981 | Bustos . | |
| 4,043,483 | 8/1977 | Gore et al. . | |
| 4,762,236 | 8/1988 | Jackle et al. | 211/59.3 |
| 4,765,493 | 8/1988 | Kinney | 211/59.2 |
| 4,901,869 | 2/1990 | Hawkinson et al. | 211/59.3 |
| 4,909,402 | 3/1990 | Highsmith | 211/184 |
| 5,161,704 | 11/1992 | Valiulis . | |
| 5,203,463 | 4/1993 | Gold . | |
| 5,390,802 | 2/1995 | Pappagallo et al. | 211/59.3 |
| 5,450,968 | 9/1995 | Bustos | 211/184 X |
| 5,469,976 | 11/1995 | Burchell | 211/59.3 |
| 5,593,048 | 1/1997 | Johnson | 211/59.2 |
| 5,673,801 | 10/1997 | Markson | 211/90.02 X |
| 5,839,588 | 11/1998 | Hawkinson | 211/184 X |

FOREIGN PATENT DOCUMENTS

| | | |
|---|---|---|
| 41770/93 | 1/1994 | Australia . |
| 215 751 A2 | 3/1987 | European Pat. Off. . |
| 408 400 A1 | 1/1991 | European Pat. Off. . |
| 0 685 192 A1 | 12/1995 | European Pat. Off. . |
| 2 562 338 | 11/1983 | France . |
| 2 593 691 | 8/1987 | France . |
| 196 09 432 | 9/1997 | Germany . |
| 9401464 | 4/1996 | Netherlands . |
| WO 86/06595 | 11/1986 | United Kingdom . |
| 2 284 143 | 5/1995 | United Kingdom . |
| 2 285 434 | 7/1995 | United Kingdom . |
| 2 291 788 | 2/1996 | United Kingdom . |
| WO 96/17607 | 9/1993 | WIPO . |
| WO 95/05768 | 3/1995 | WIPO . |

*Primary Examiner*—Robert W. Gibson, Jr.
*Attorney, Agent, or Firm*—Merchant & Gould P.C.

[57] ABSTRACT

A shelving system including: (a) a frame (18); (b) the frame having a rear member (22), a front member (24) spaced from the rear member (22), and at least one side (20) joining the front member (24) and the rear member (22); (c) the rear member (22) having a rear attachment portion (36), the rear attachment portion (36) having a front face (60) with a plurality of grooves (62) therein; (d) the front member (24) having a front attachment portion (38), the from attachment portion (38) having a rear face (48) with a plurality of grooves (50) therein; (e) at least one product support (30, 32, 34) extending between and being supported by the rear member (22) and the front member (24); (f) the product support (30, 32, 34) having at least one fin (78, 80) depending therefrom to engage in at least one of the grooves (50, 62) of the front attachment portion (38) and rear attachment portion (36).

31 Claims, 30 Drawing Sheets

SHELVING SYSTEM

FIELD OF THE INVENTION

This invention relates to shelving systems and refers particularly, though not exclusively, to a shelving system for the display of products.

BACKGROUND OF THE INVENTION

Many stores and supermarkets use shelving systems for the display of products for promotional purposes, or for sale. These shelving systems normally comprise a base having a number of vertical posts. Each post has a series of slots in the front face to enable shelf supports to be slotted therein. Each shelf support has a number of slits in its upper edge adapted to releasably retain therein clips attached to shelves, which are supported by the shelf supports. The products for display can then be placed on the shelves. If several different products are placed on a particular shelf, it is quite often desired to separate those products according to categories. It then becomes necessary to have dividers attached to the shelf. If that is not done, the products of different categories may become intermixed. This can cause confusion for a potential purchaser.

With supermarkets, the intermixing of products makes it difficult for those replenishing the stock of products on the shelves to determine what categories of products need replenishing. Also, with the use of bar codes and laser detection at check-outs, the price of each product must be accurately displayed on the front of the shelf where the products are located. If the products become intermixed, this cannot happen.

Furthermore, such shelving systems do not allow all forms of products to be displayed to their best advantage to enable an intending purchaser to see the product, and to be able to determine what it is.

Also, with the known shelving systems, the shelf is usually horizontal so that for those products arranged in lines extending towards the rear of the shelf, when the first few products have been removed, it may be difficult to see or reach those at the rear of the shelf.

BRIEF DESCRIPTION OF THE INVENTION

The present invention therefore provides a shelving system including:

(a) a frame;

(b) the frame having a rear member, a front member spaced from the rear member, and at least one side joining the front member and the rear member;

(c) the rear member having a rear attachment portion, the rear attachment portion having a front face with a plurality of grooves therein;

(d) the front member having a front attachment portion, the front attachment portion having a rear face with a plurality of grooves therein;

(e) at least two product supports extending between and being supported by the rear member and the front member;

(f) the product supports each having at least one fin depending therefrom to engage in at least one of the grooves of the front attachment portion and rear attachment portion (g) the product supports each having a horizontal shelf member, the horizontal shelf members of adjacent product supports being adapted to receive thereon at least one product to be displayed.

Advantageously, the product supports are spaced apart so that the horizontal shelf members of adjacent product supports do not contact each other. Preferably, the front and rear members are parallel. Preferably, the product supports are parallel to each other.

Preferably, the product support has a vertically extending web. Advantageously, at least one of the shelf member and the vertical web has a longitudinally extending raised rib thereon. More advantageously, both the shelf member and the vertical web have at least one longitudinally extending rib.

Advantageously, the frame has a rod extending parallel to but between the front member and the rear member. Preferably, the rod is round or square. More preferably, the product support has depending therefrom a clip adapted to releasably engage the rod.

Preferably, the product support has two fins depending therefrom, one at each end of the product support. Alternatively, it may have one fin extending for a substantial portion of the length of the product support. Preferably, the one fin may incorporate the clip.

More preferably the product support is inversely T-shaped, or L-shaped.

Advantageously, the vertical web of the product support has a transverse member at its rear end to strengthen the web and/or to prevent product on the product support moving rearwardly past the transverse member. Preferably, a second transverse member is provided at the front of the product support. More advantageously, the vertical web of the product support is of reduced height at its front. Preferably, the portion of reduced height tapers from a first height to a second height.

The front attachment portion and/or rear attachment portion may be integral, or separate components. If separate components they may be a front attachment member and rear attachment member.

Preferably, the front attachment member is of a height such that it extends vertically upwardly beyond the front member. Advantageously, that part of the front attachment member extending beyond the front member is transparent.

Preferably, the rear attachment member is of a height such that it extends vertically upwardly beyond the rear member.

Preferably, there are two products supports in side-by-side relationship to retain a slide on the adjacent shelf members and substantially between their vertical webs. More preferably, there is a slide rod extending from the front attachment member to the rear attachment member and passing through a rod aperture in the slide. Advantageously, there is a biasing means to bias the slide towards the front member. More advantageously, the biasing means is a spring, preferably a clock spring, acting on the slide.

Preferably, the slide has a body in which is located the rod aperture, and a product engaging member extending upwardly from the body.

The invention may also provide a shelving system including a frame; the frame having a rear member, a front member spaced from the rear member, and at least one side joining the front member and the rear member, an upwards projection on the rear member, and a shelf releasably attached to the frame, the shelf having a rear groove member having an elongate groove therein to receive the upwards projection.

DESCRIPTION OF THE DRAWINGS

Preferred embodiments of a shelving system incorporating the principal features of the present invention will now be described with reference to the accompanying illustrative drawings, in which:

To refer to the drawings, FIGS. 1 and 2 show two substantially identical vertical posts 10 each having a series of slots 14 in their front faces 12. Into slots 14 there is fitted in the known manner a shelf support 16. Two such shelf supports 16 (one for each post 10) support a frame 18.

Figure 1:
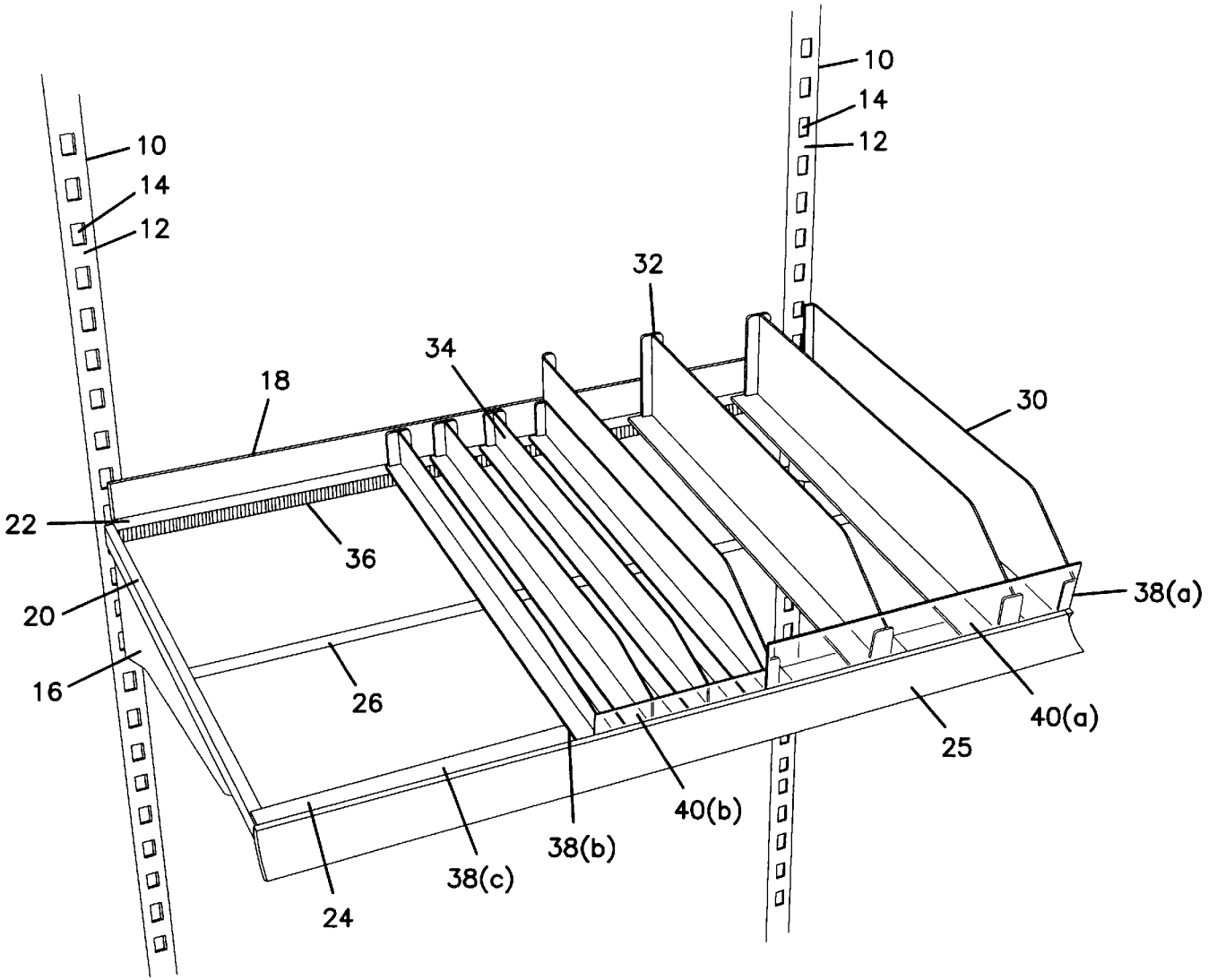
FIG. 1 is a front perspective view of a shelving system according to the present invention.
Figure 2B:
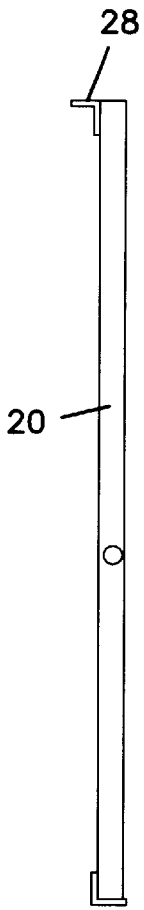
FIG. 2 is a (*a*) plan view, (*b*) side view of the frame of the shelving system of FIG. 1.
Figure 2A:
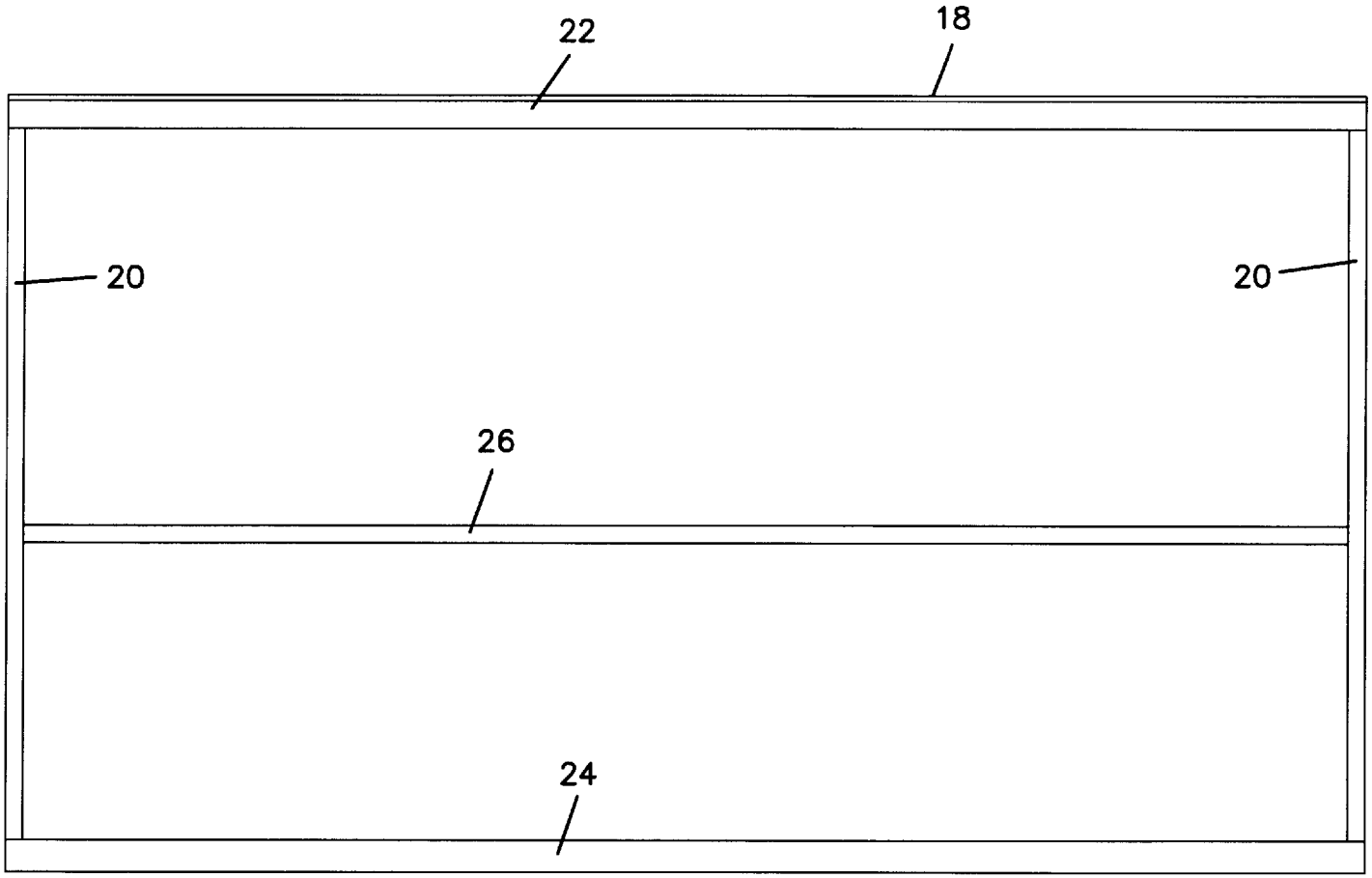

The frame 18 has two spaced apart sides 20, each of which engages supports 16 in a releasable, but secure manner. The sides 20 join a rear member 22 and a front member 24, which are substantially parallel. A rod 26 intermediate the front member 24 and rear member 22 extends between the sides 20. The rod 26 is preferably round. The rear member 22 may have a short, vertically upwardly extending extension 28.

Releasably attached to rear member 22 is a rear attachment member or members 36. Rear attachment member 36 may be sufficiently long to extend between sides 20, or may be shorter such that a plurality of such members 36 are required. Similarly, a front attachment member or members 38 are releasably attached to front member 24. The front attachment member 38 may be in one of three forms—that 38(*a*) with a large vertical extension 40(*a*); 38(*b*) with a short vertical extension 40(*b*); or 38(*c*) with no vertical extension.

Three forms of product supports are shown in FIG. 1—an end product support 30, a large product support 32, and a small product support 34.

Figure 3:
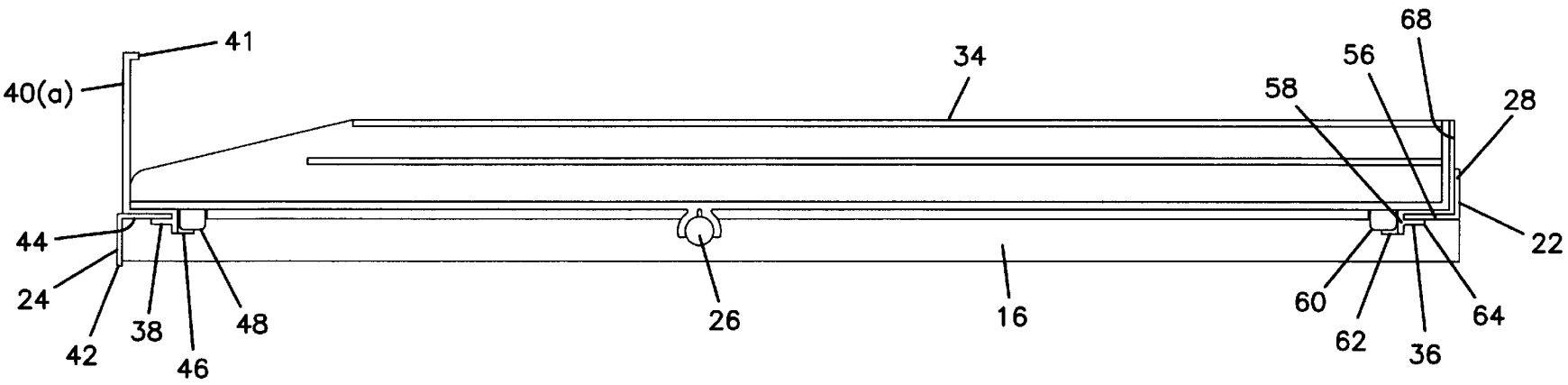
FIG. 3 is a vertical cross-section along the lines and in the direction of arrows 3—3 of FIG. 1.
Figure 4A:
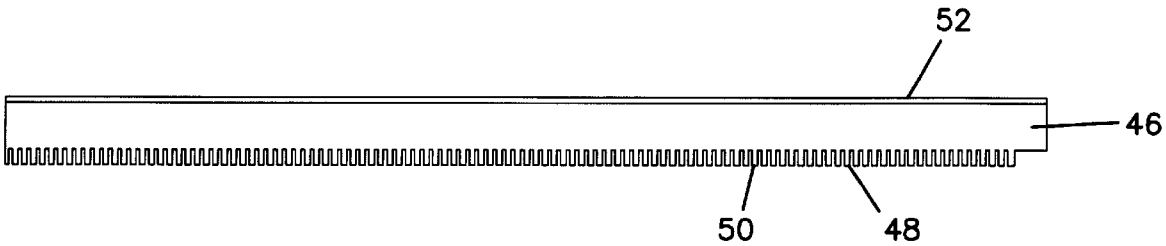
FIG. 4 is (*a*) plan view, (*b*) front view, (*c*) side view of a front attachment member of FIG. 1.
Figure 4B:
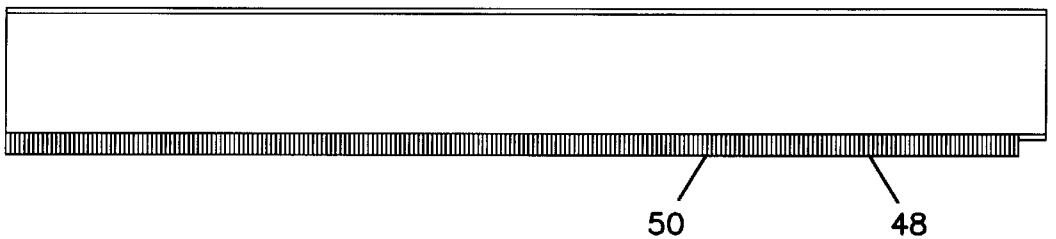
Figure 4C:
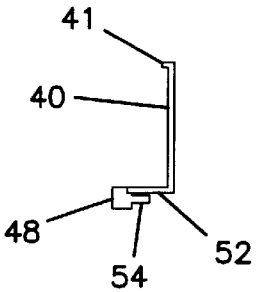
Figure 5A:
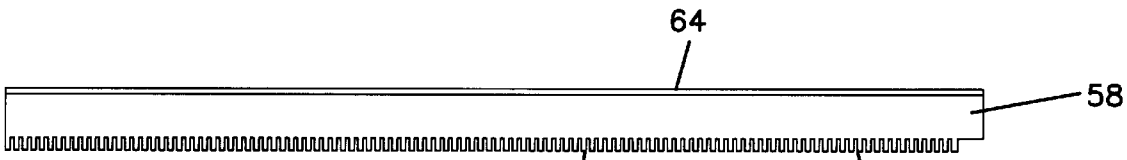
FIG. 5 is a (*a*) plan view, (*b*) front view, (*c*) side view of a rear attachment member of FIG. 1.
Figure 5B:
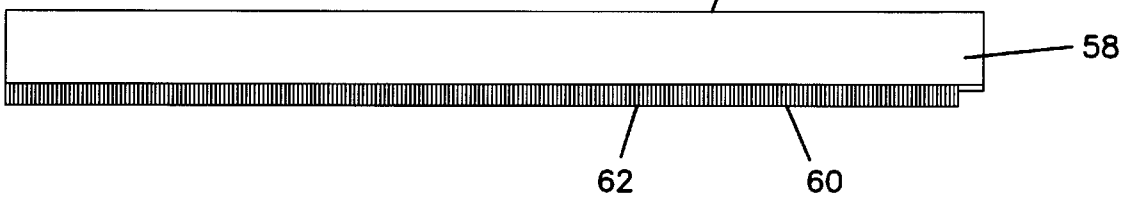
Figure 5C:
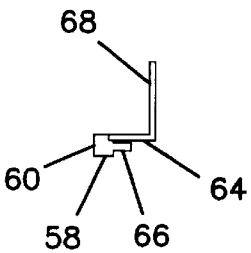

To refer now to FIGS. 3, 4 and 5, it can be seen that the front member 24 has a vertical web 42 and a horizontal, rearwardly extending member 44. The front attachment member 38 has a body portion 46 having a plurality of vertically extending grooves 50 in its rear face 48. Its front face 52 has an elongate slot 54 therein which engages member 44 to releasably attach front attachment member 38 to member 44. The body portion 46 extends over member 44 and terminates with a vertical extension 40, in this instance the higher vertical extension 40(*a*). At its upper end, extension 40 has a rearwardly extending projection 41, to prevent unwanted contact between a product (not shown) and extension 40, and/or to allow for products with a bulbous base such as, for example, bottles for spices.

The rear member 22 has a horizontal portion 56 and the vertical extension 28. The rear attachment member 36 has a body portion 58 with a plurality of grooves 62 in its front face 60. Its rear face 64 has an elongate slot therein which engages member 56 to releasably attach rear attachment member 36 to member 56. The body portion 58 extends over member 56 and terminates with a vertical extension 68.

Figure 6A:
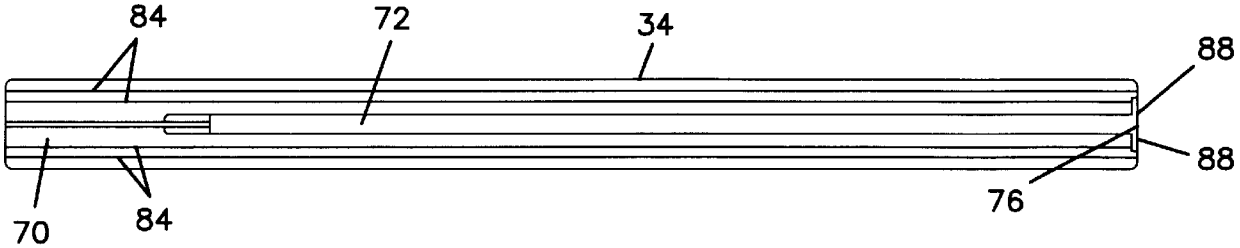
FIG. 6 is a (*a*) plan view, (*b*) side view, (*c*) front end view of a product support of FIG. 1.
Figure 6B:
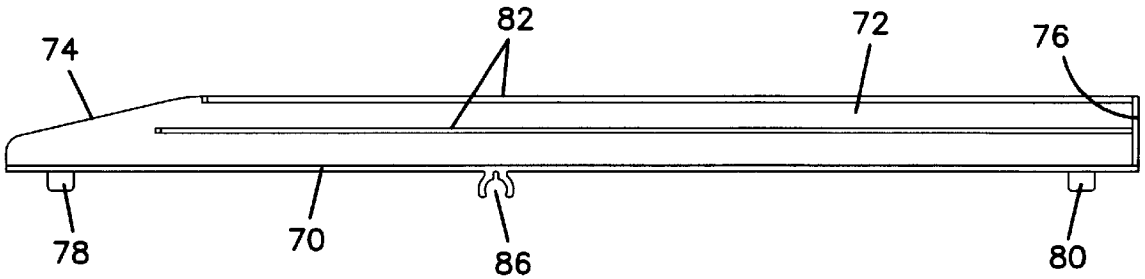
Figure 6C:
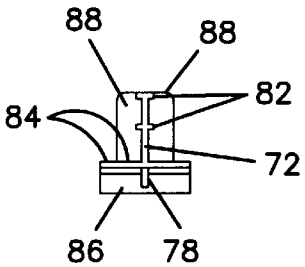

The product support 34 (FIGS. 3 and 6) has a horizontal shelf member 70 and a vertical web 72. Its front 74 rest on front attachment member 38 and abuts vertical extension 40(*a*). Its rear 76 rests on rear attachment member 36 and abuts vertical extension 68. In this way the product support 34 is located in a front to rear direction. To locate along the front and rear members 22, 24, the horizontal member 70 has depending therefrom a front fin 78 which engages in one of grooves 50, and a rear fin 80 which engages in one of grooves 62. This provides for a secure, yet releasable, location of the product support 34 relative to the frame 18.

The web 72 is of constant height throughout its length except that adjacent the front 74 it tapers downwardly to a lesser height at the front 74. Extending along the greater part of the length of web 72 there may be a number of ribs 82 extending outwardly from web 72. Preferably, ribs 82 are on both sides of web 72. Ribs 82 allow product to slide along product support 34 with reduced surface contact and thus reduced friction and/or to allow for products which have a bulbous base such as, for example, bottles for spices.

Similarly, horizontal shelf member 70 may have a plurality of upstanding ribs 84 to reduce the surface contact of product to thus reduce friction and allow product to slide along product support 34 more easily.

Also depending from product support 34 is a clip 86 adapted to releasably engage rod 16 to assist in locating product support 34 relative to frame 18, and to provide extra strength to product support 34 to prevent undesired bowing, or fracture, due to the weight of product on horizontal shelf member 70.

The product support 34 has a laterally extending member 88 at rear 76 and extending on either side of web 72 to prevent product sliding out the rear of product support 34 and/or to strengthen web 72.

Figure 7A:
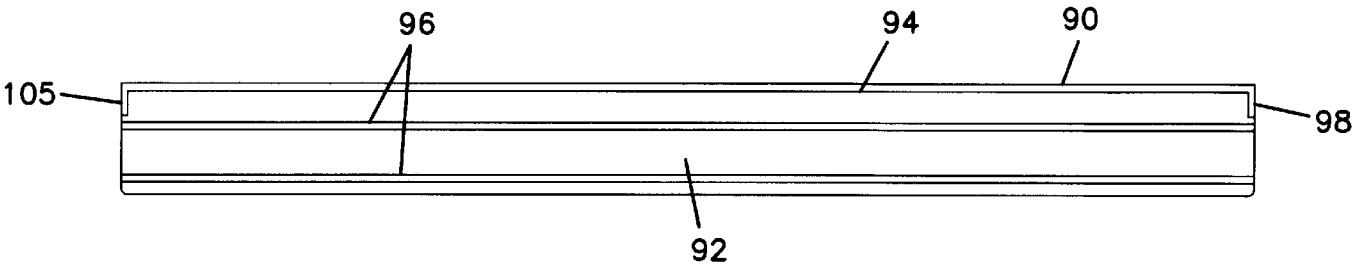
FIG. 7 is a (*a*) plan view, (*b*) side view, (*c*) front end view of a different product support of FIG. 1.
Figure 7B:
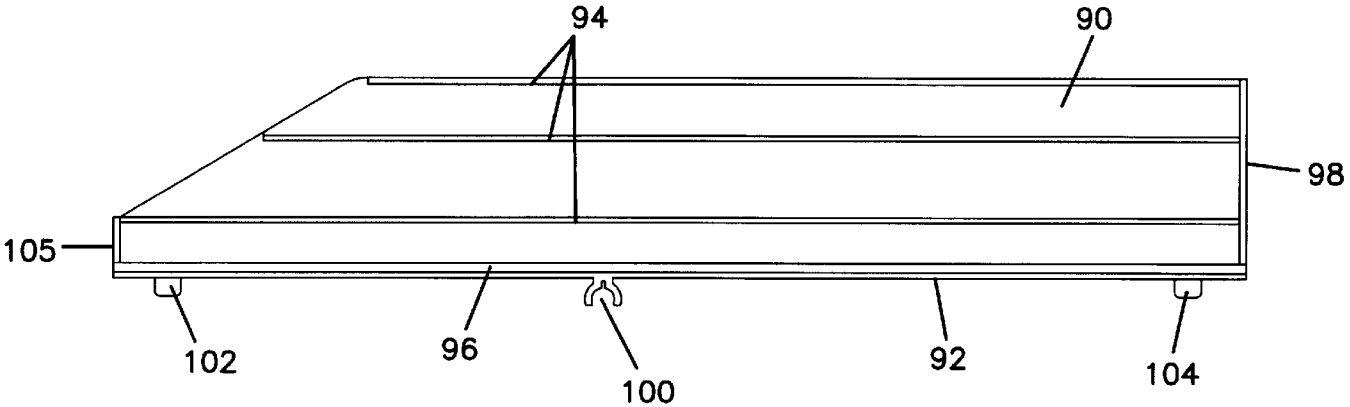
Figure 7C:
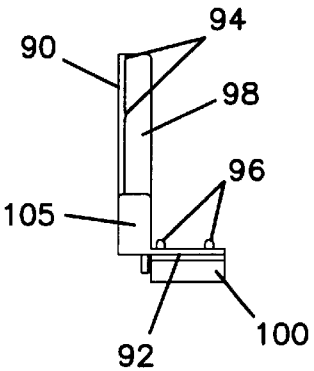

To refer now to FIG. 7, there is shown the end product support 30. As is clear from FIG. 7(*c*), product support 30 is L-shaped. It has a vertical web 90, and a horizontal shelf member 92 on one side only of web 90. Web 90 has ribs 94 on one side only, and ribs 96 on shelf member 92. Ribs 94, 96 function similarly to ribs 82, 84. In all other respects, product support 30 operates the same as product support 34 in that it has a lateral member 98, clip 100, front fin 102 and rear fin 104. It also has a front lateral member 105 which operates similarly to rear lateral member 98.

Figure 8A:
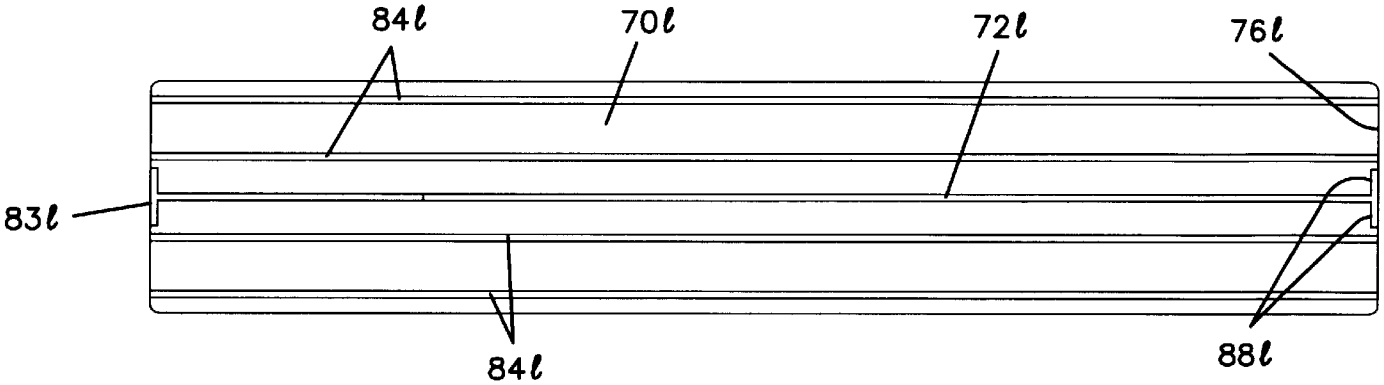
FIG. 8 is a (*a*) plan view, (*b*) side view, (*c*) front end view of a third product support of FIG. 1.
Figure 8B:
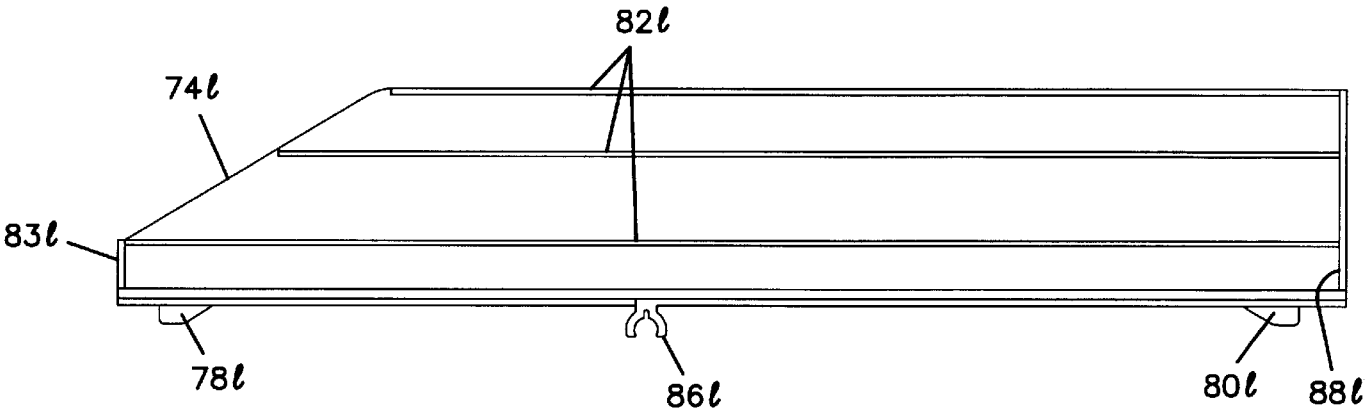
Figure 8C:
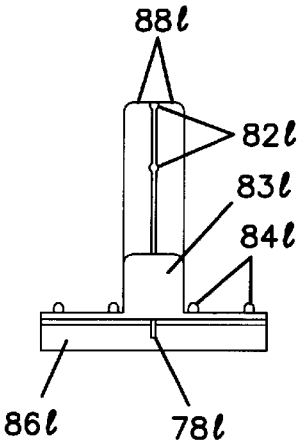

FIG. 8 shows the large product support 32 which is identical in all respects to small product support 34 except for certain features. The same reference numerals will be used as for small product support 34 with the addition of the letter "1". As can be seen, the web 721 is taller, with more ribs 821. It also has a front lateral member 83, which operates in the same manner and for the same purpose as rear lateral member 881.

Figure 9:
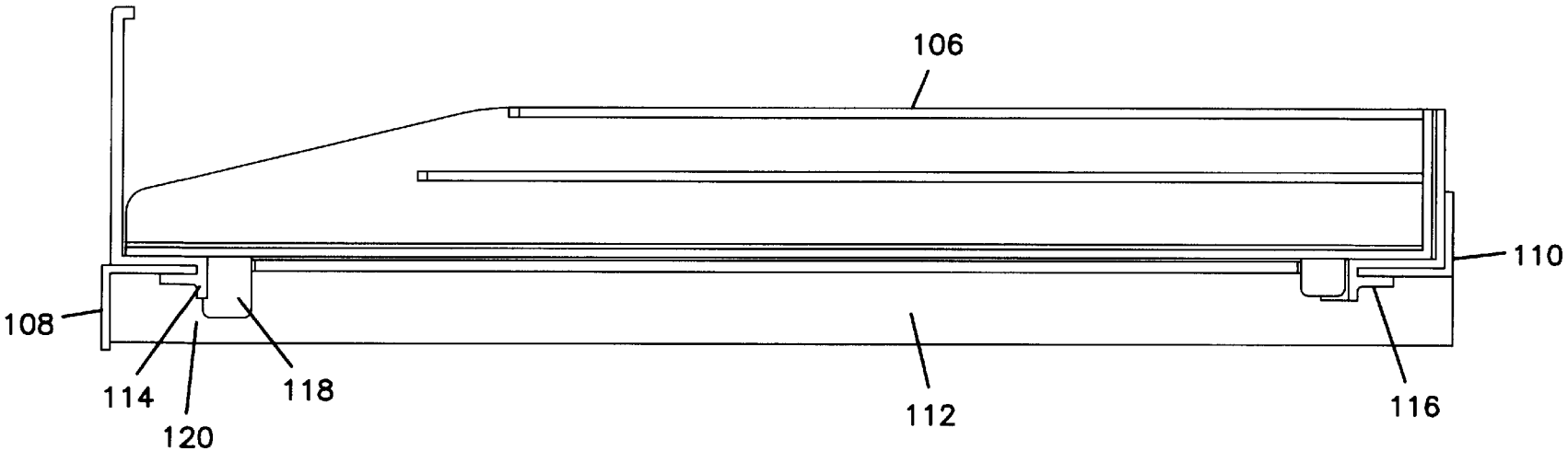
FIG. 9 is a vertical cross-sectional view similar to that of FIG. 3 but of a second embodiment.

In FIG. 9 there is shown a second embodiment for shelves of lesser depth. The principal difference is the lack of a central rod. Therefore, the frame has front member 108, rear member 110 and sides 112, as before. The front attachment member 114 is the same as front attached member 38, and rear attachment member 116 is the same as rear attachment member 36. Product support 106 is substantially the same as product support 34, except for the lack of a clip, due to there being no rod. Front fin 118 may have a barb 120 extending under front attachment member 114, to assist in the securing of product support 106 relative to front member 108.

In use, the frame 18 is placed in location on the shelf supports 16 and located into position. The front attachment members 38 and rear attachment members 36 are then located on front member 24 and rear member 22 respectively. End product supports 30 are then located at each end of frame 18, with fins 102, 104 engaging in grooves 50, 62 respectively and clip 100 engaging rod 26. Products supports 32, 34 are then similarly located along frame 18, with the distance between webs 72, 721 being determined by the 20 width of the products to be displayed. The bases of the products being displayed rest on shelf members 70, 92. Preferably, the frame 18 is at an angle of approximately 15° to the horizontal, rear higher, to allow product to slide along product supports 30, 32, 34 towards the front.

It is preferred that a product of a single category is placed in each "run"—the gap between adjacent webs 72, 90. In that way, there can be no intermixing of product.

Similarly, extensions 40 are preferably of a transparent material so the contents of each "run"—the product being displayed—can be easily seen. Furthermore, as the product category in each run is the same, identifying data can be place on front surface 25 of front member 24 for further ease of identity of the contents of that run. That data may 30 include the price of the products in that run and/or promotional information.

Figure 10:
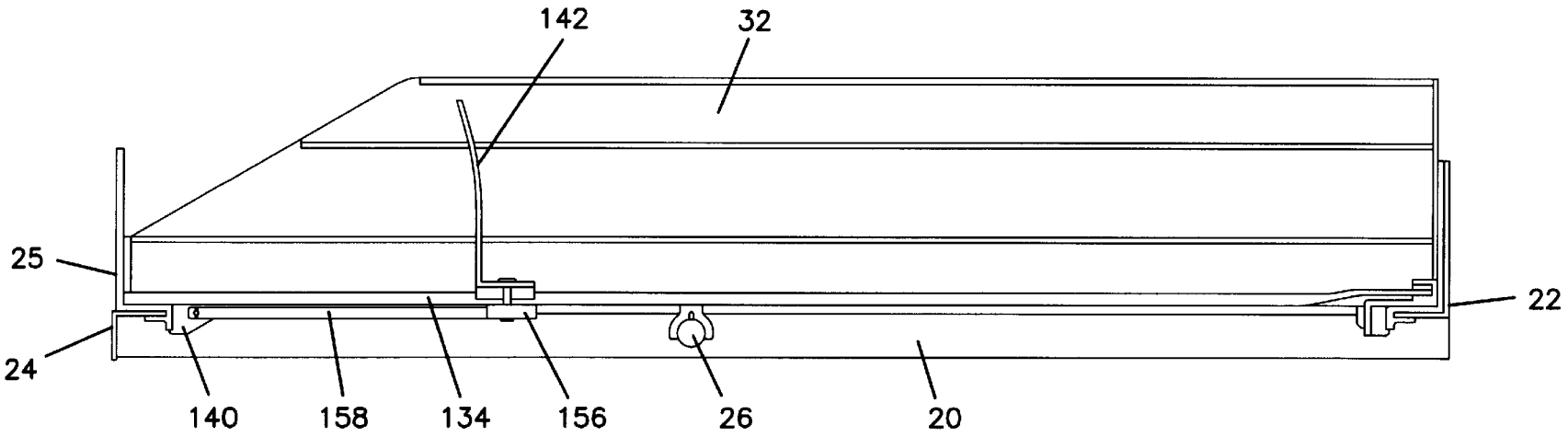
FIG. 10 is a vertical cross-sectional view similar to that of FIG. 3 but of a third embodiment.
Figure 11A:
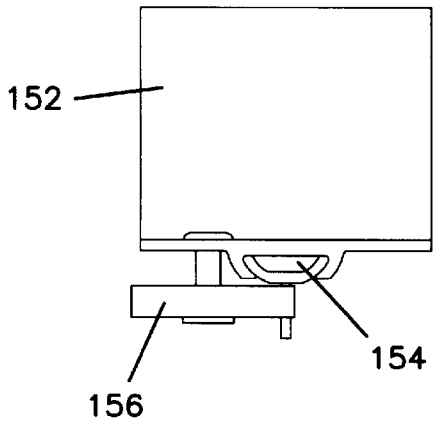
FIG. 11 is a (*a*) front view, (*b*) side view of a first form of slide for use with the third embodiment of FIG. 10.
Figure 11B:
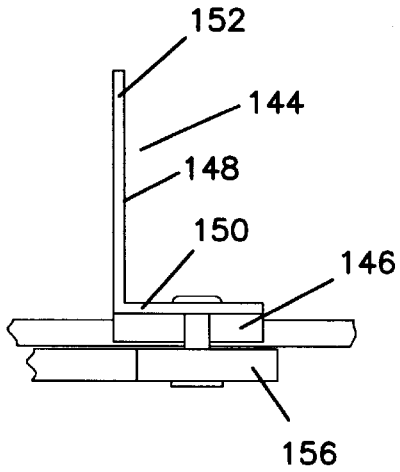

In some instances, products to be displayed do not stand up easily-eg small boxes, sachets, and so forth. Some products may require self-feeding towards the front. Therefore, a support for the products may be provided. This is shown in FIGS. 10 to 14, the third embodiment. The frame 18 is used, as are the product supports 30, 32, 34. In FIG. 10, product support 32 is shown.

As there is a gap between the shelf members 70, 92 of adjacent product supports 30, 32, 34, a rear rod organiser 122 (FIG. 14) is located in rear attachment member 36.

Organiser 122 has a fin 124 depending from a body 126 and rearwardly from front 132. At the rear of body 126 is an upstanding socket member 128 having a shaped socket 130 therein. Fin 124 engages in one of the grooves 62.

A rod 134 has a shaped rear end 136, axially displaced, and shaped so to be received in socket 130. Rod 134 has a front end 138 with a fin 140 depending therefrom and to be located in a groove 50. Rod 134 may be round or, as shown, concave.

Figure 12A:
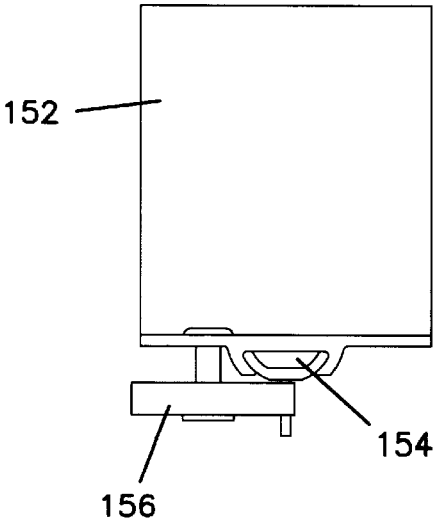
FIG. 12 is a (*a*) front view, (*b*) side view of a second form of slide for use with the third embodiment of FIG. 10.
Figure 12B:
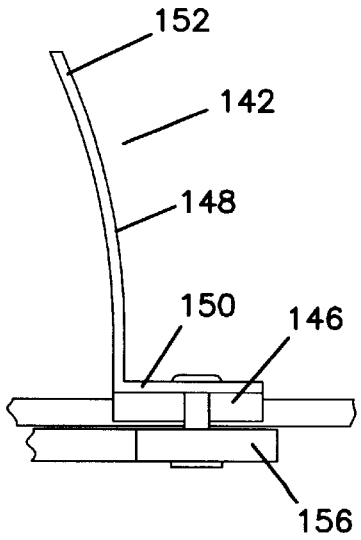
Figure 13B:
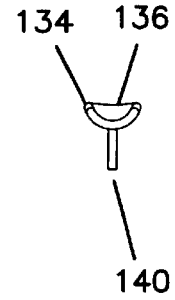
FIG. 13 is a (*a*) side view, (*b*) front end view of the slide rod for use with the third embodiment of FIG. 10.
Figure 13A:
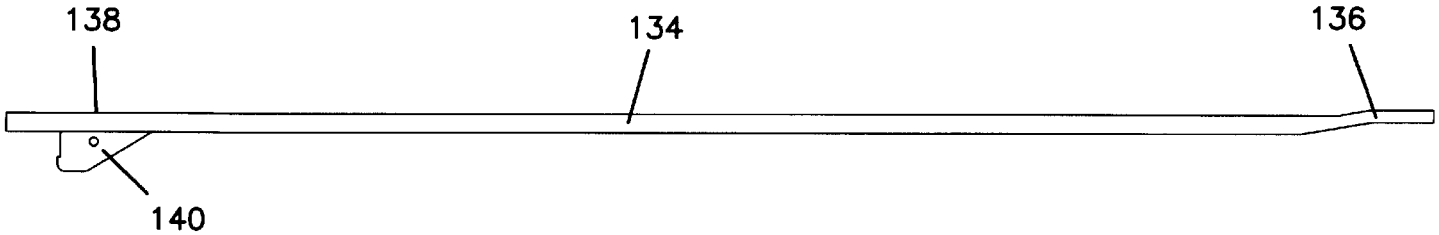
Figure 14A:
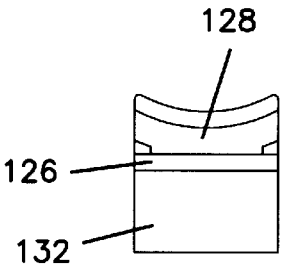
FIG. 14 is a (*a*) front view, (*b*) side view, (*c*) rear view of a rear rod organizer for use with the third embodiment of FIG. 10.
Figure 14B:
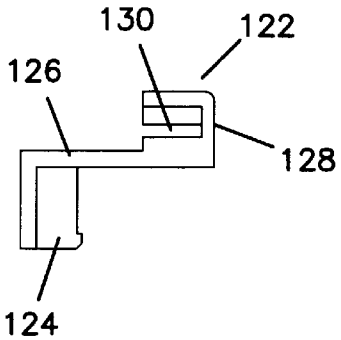
Figure 14C:
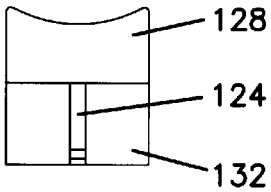

Two forms of support may be used. The first is a slide 142 as shown in FIGS. 10 and 12, with the second slide 144 of FIG. 11 being a variation thereof.

Slides 142 has a body 146 with an L-shaped member 148 attached thereto. L-shaped member 148 has a horizontal portion 150 and vertical position 152 adapted to support the vertical face of product. This may be curved as shown for the slide 142, or straight for slide 144.

Body 146 has an aperture 154 therethrough which has rod 134 passing therethrough.

Also depending from body 146 is a spring retainer 156 adapted to have attached thereto the outer end of a clock spring 158, the other end of which is attached to front attachment member 38 or front member 24. In this way, slide 142, 144 can be moved rearwardly to tension the spring 158. The product can be placed in the "run" and vertical component 152 will press against the product, not only forcing towards the front under action of the spring, but also maintaining it upright.

As an alternative, a compression spring between vertical portion 152 and the vertical extension 68 of rear attachment member 36 may be used.

The spring retainer 156 may engage under a shelf member 70, 92 to further assist retaining the slides 142, 144 in position.

Figure 15A:
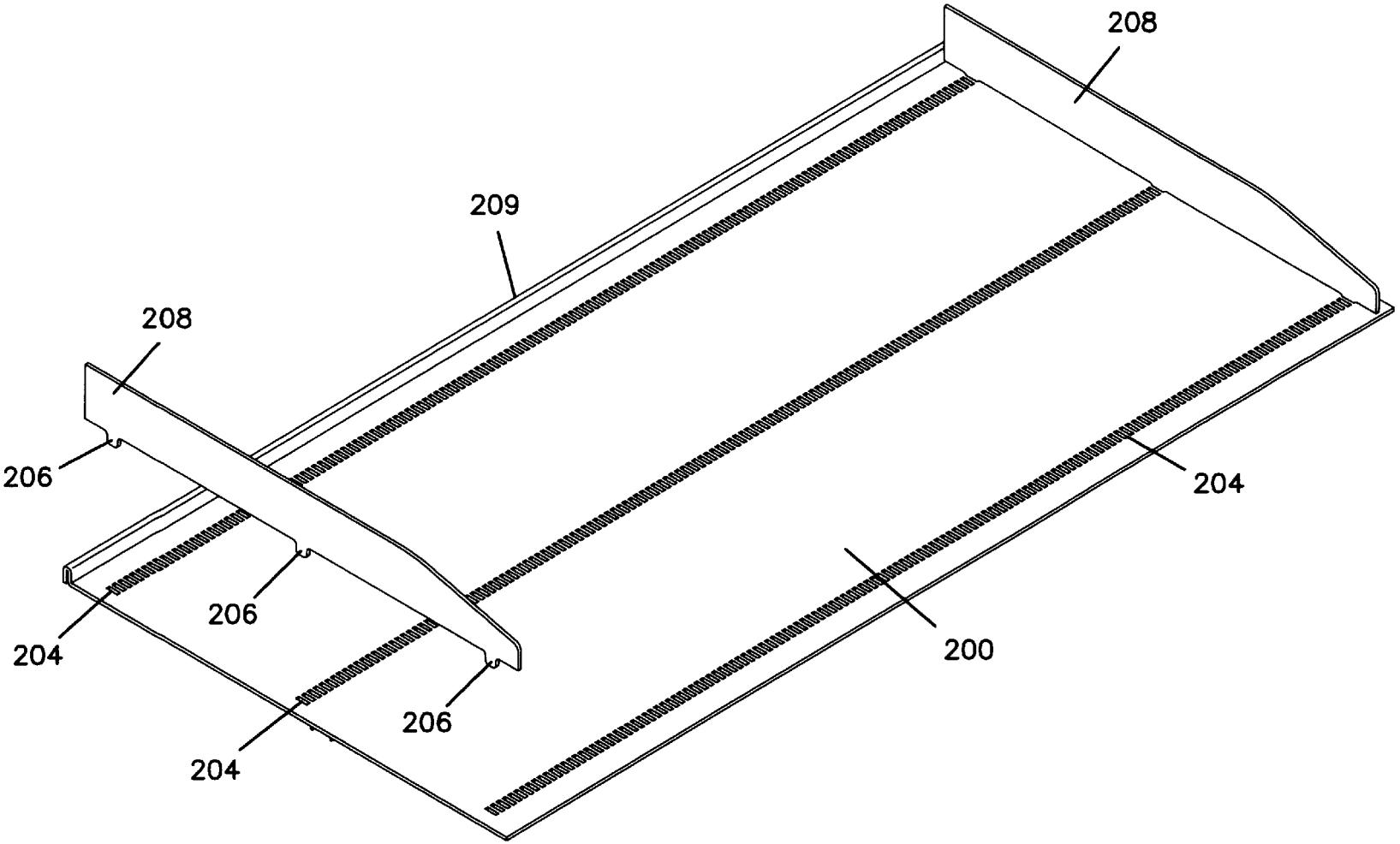
FIG. 15 is a (*a*) side exploded perspective view, (*b*) side view, (*c*) underneath view of a first tray for use with the first embodiment.
Figure 15C:
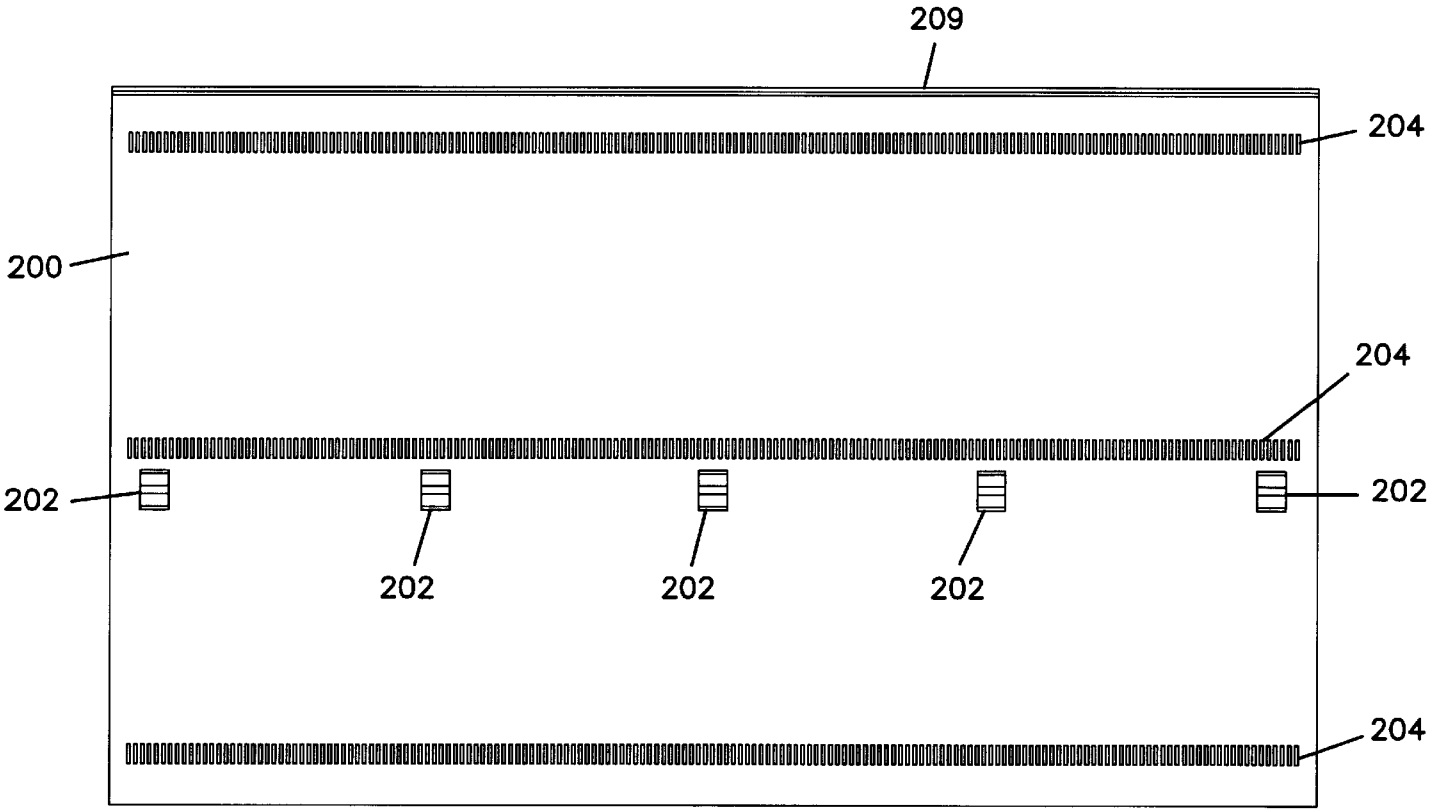
Figure 15B:
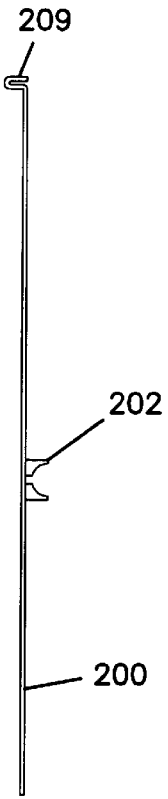

To refer now to FIG. 15, there is shown a tray 200 having a clip or clips 202 depending therefrom adapted to engage rod 26. The tray 200 is substantially flat and has a series of openings 204 adapted to receive fins 206 of a product divider 208, the openings being in two or three rows, as shown. Tray 200 has an inverted U-shaped rear projection 209 adapted to locate over projection 28 of rear member 22.

Figure 16A:
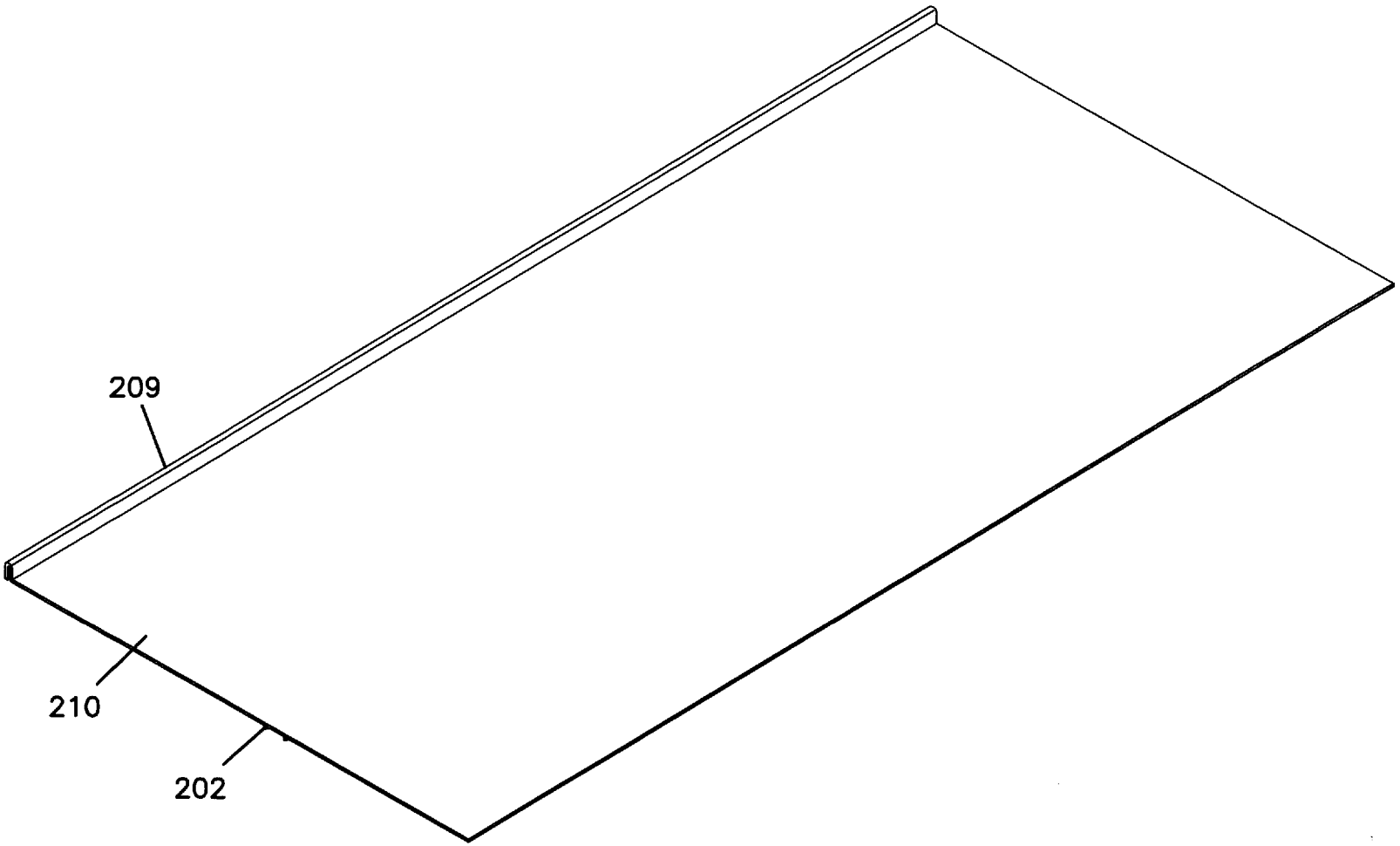
FIG. 16 is a (*a*) side perspective view, (*b*) side view, (*c*) underneath view of a second form of tray for use with the first embodiment.
Figure 16C:
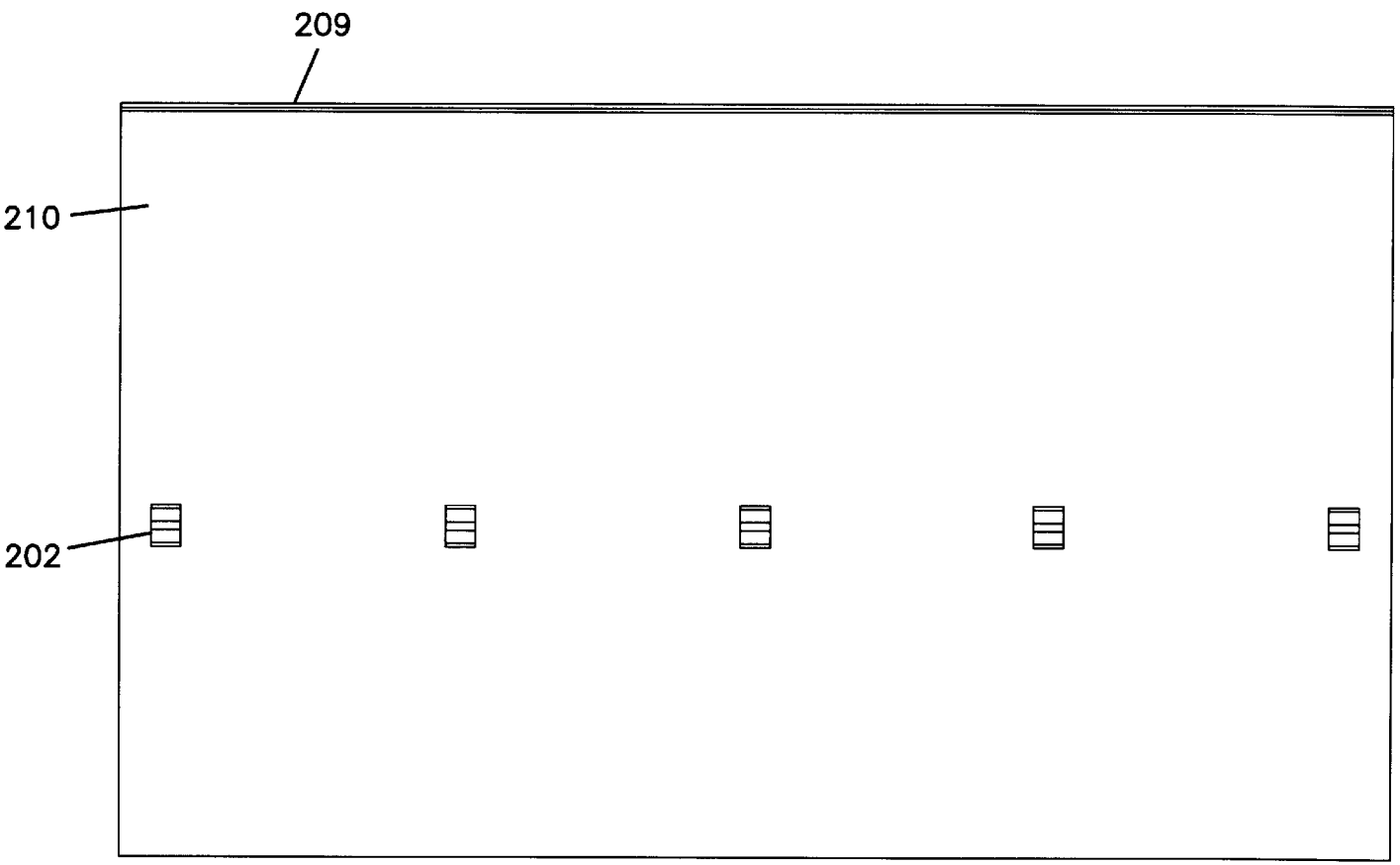
Figure 16B:
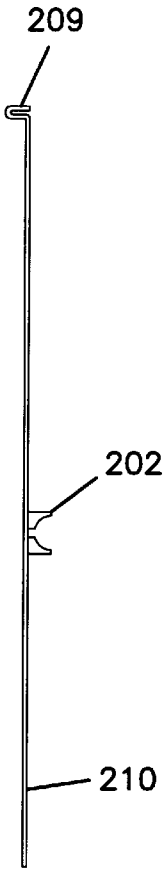

FIG. 16 shows a tray 210 being a variation of that of FIG. 15 in that there are no openings 204.

Figure 17A:
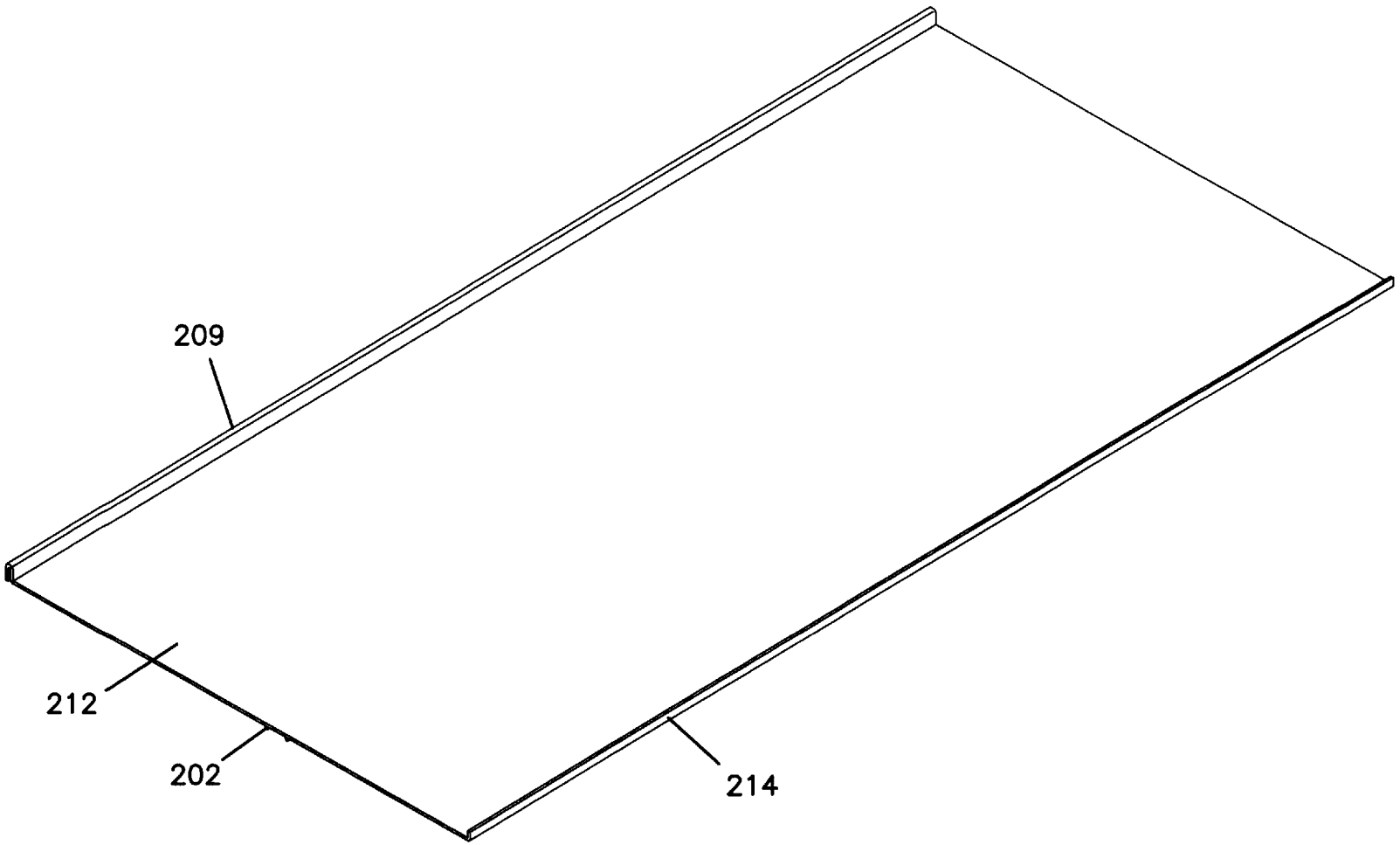
FIG. 17 is a (*a*) side perspective view, (*b*) side view, (*c*) underneath view of a third form of tray for use with the first embodiment.
Figure 17C:
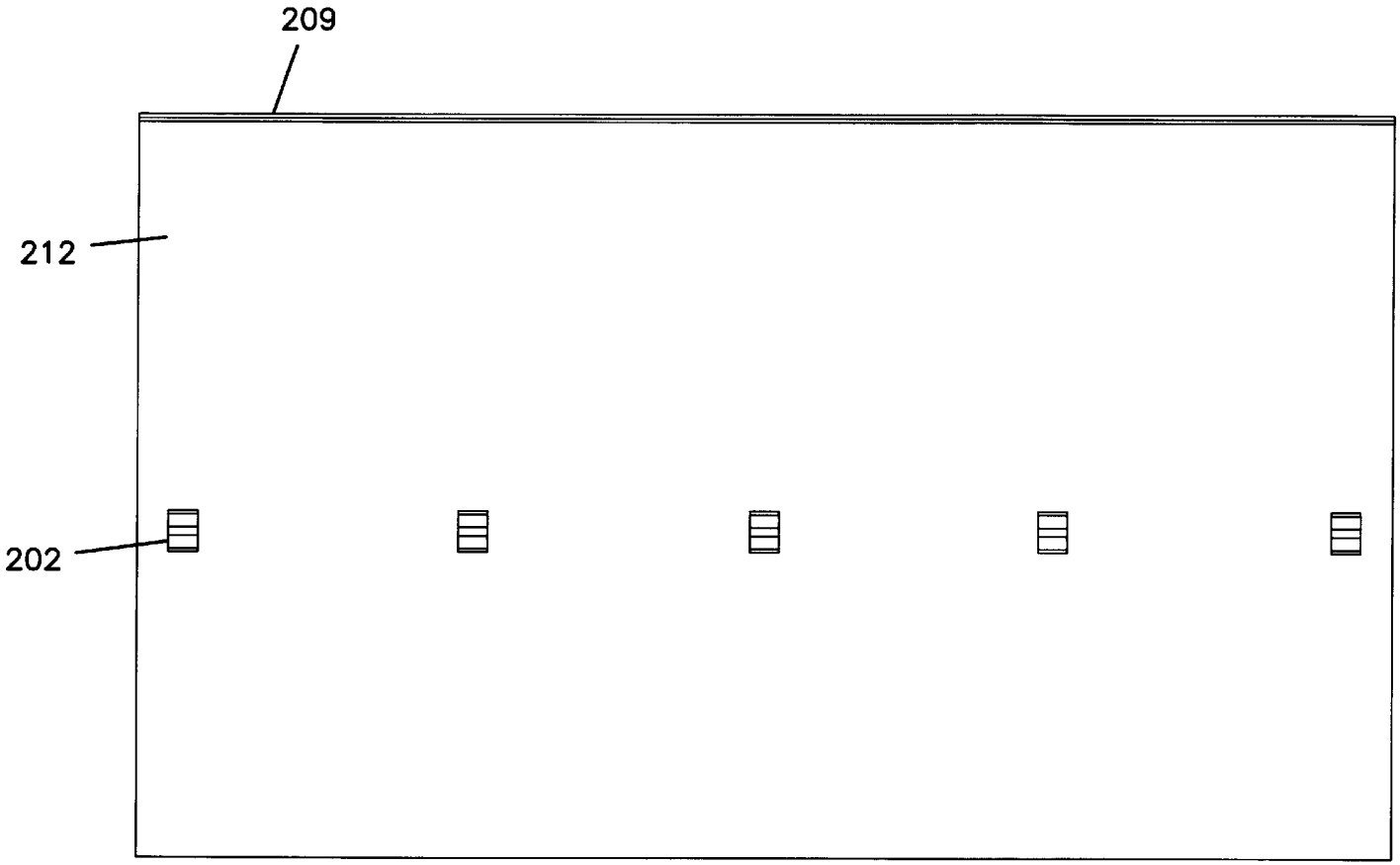
Figure 17B:
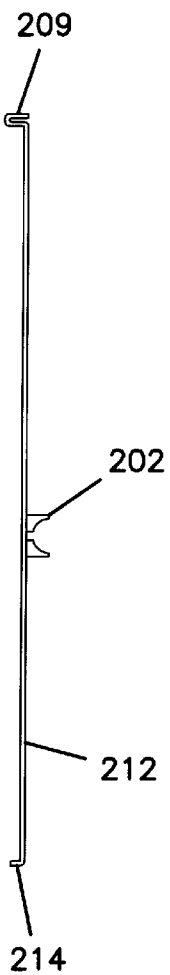

FIG. 17 shows a tray 212 being a variation of that of FIG. 16 in that a lip 214 is provided along the front of tray 212.

Figure 18A:
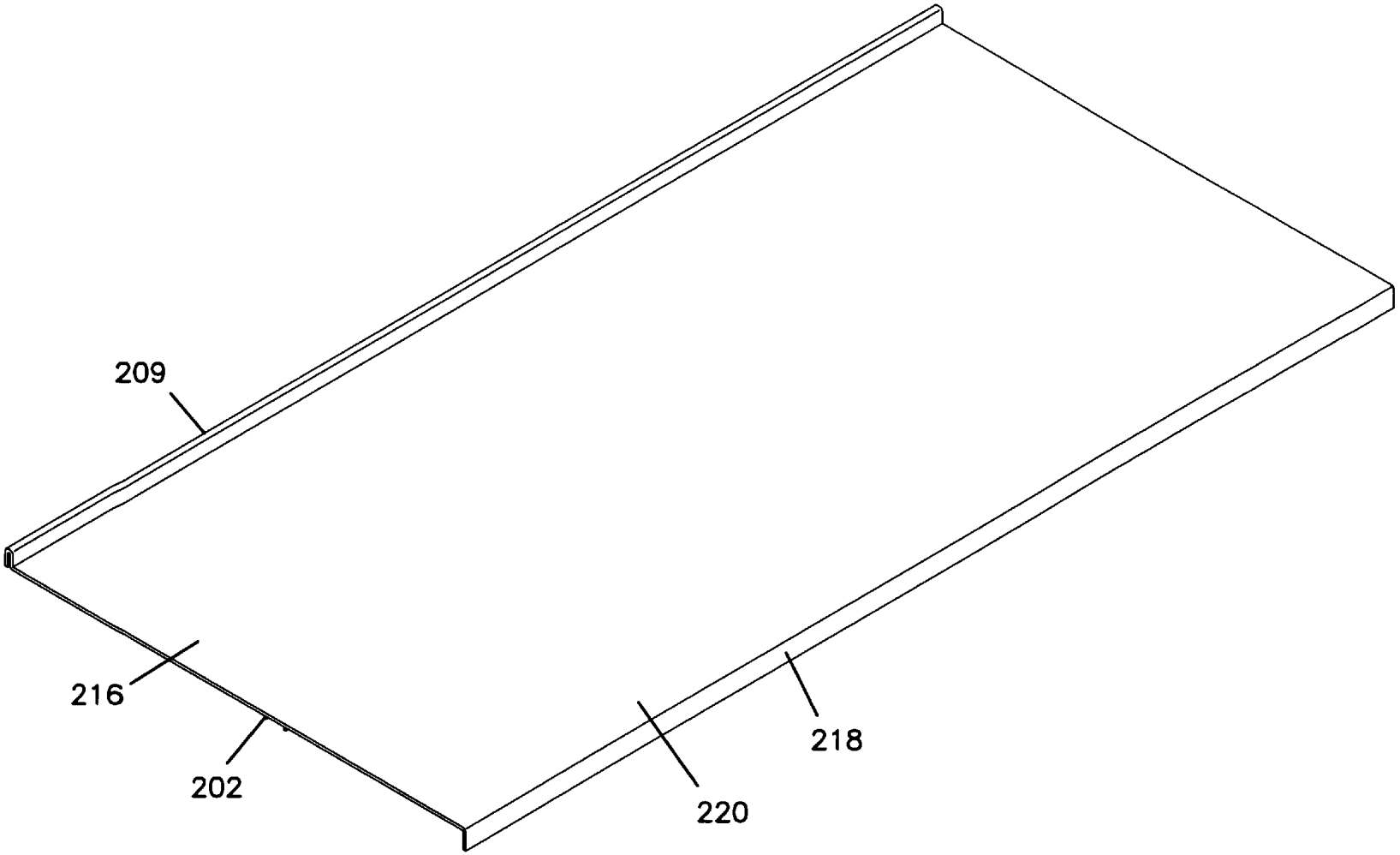
FIG. 18 is a (*a*) side perspective view, (*b*) side view, (*c*) underneath view of a fourth form of tray for use with the first embodiment.
Figure 18C:
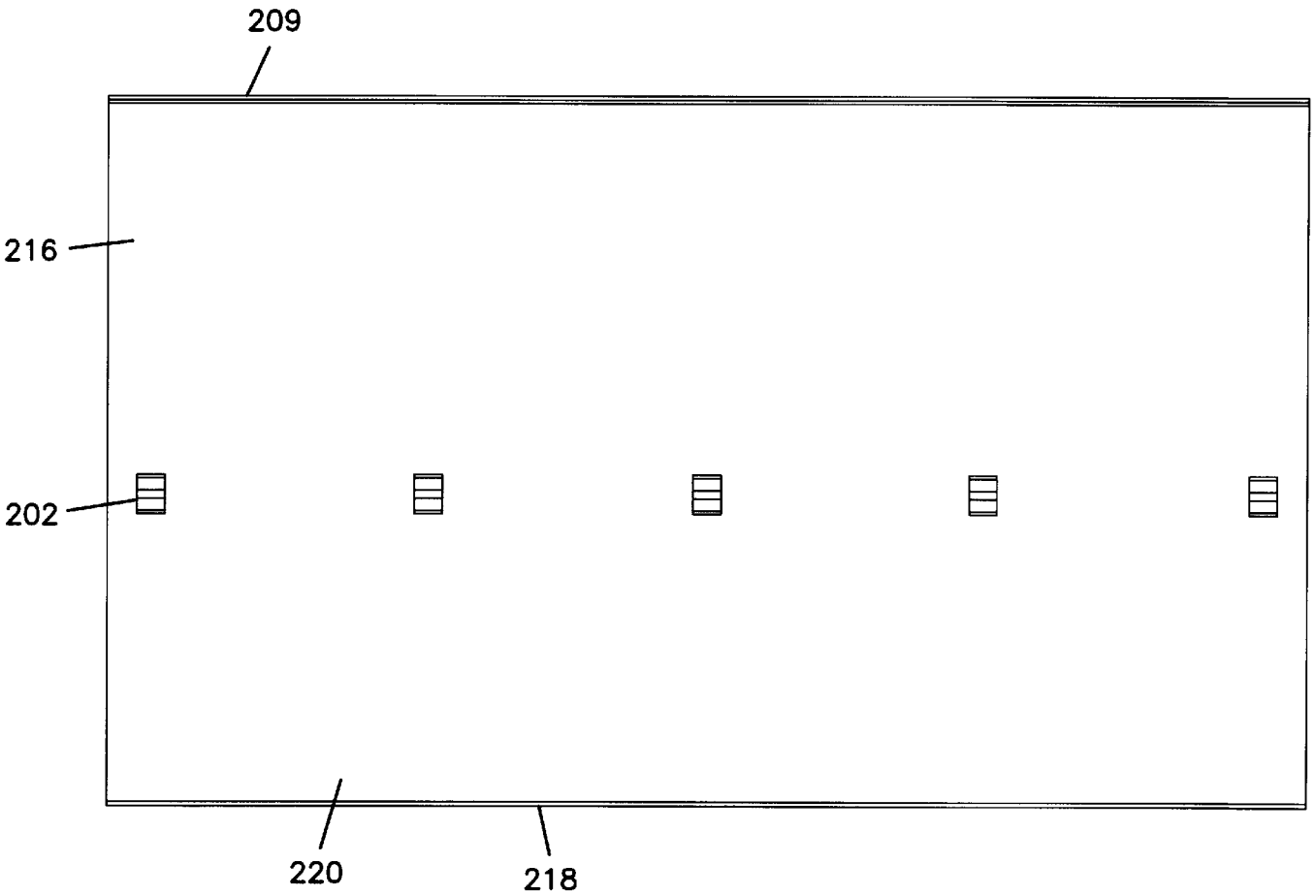
Figure 18B:
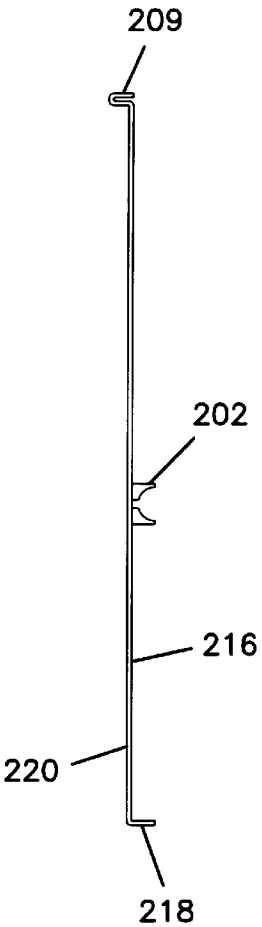

FIG. 18 shows a tray 216 being a variation of that of FIG. 16 in that a lip 218 is provided depending from front 220 of tray 216, and adapted to locate in front of front member 24.

Figure 19A:
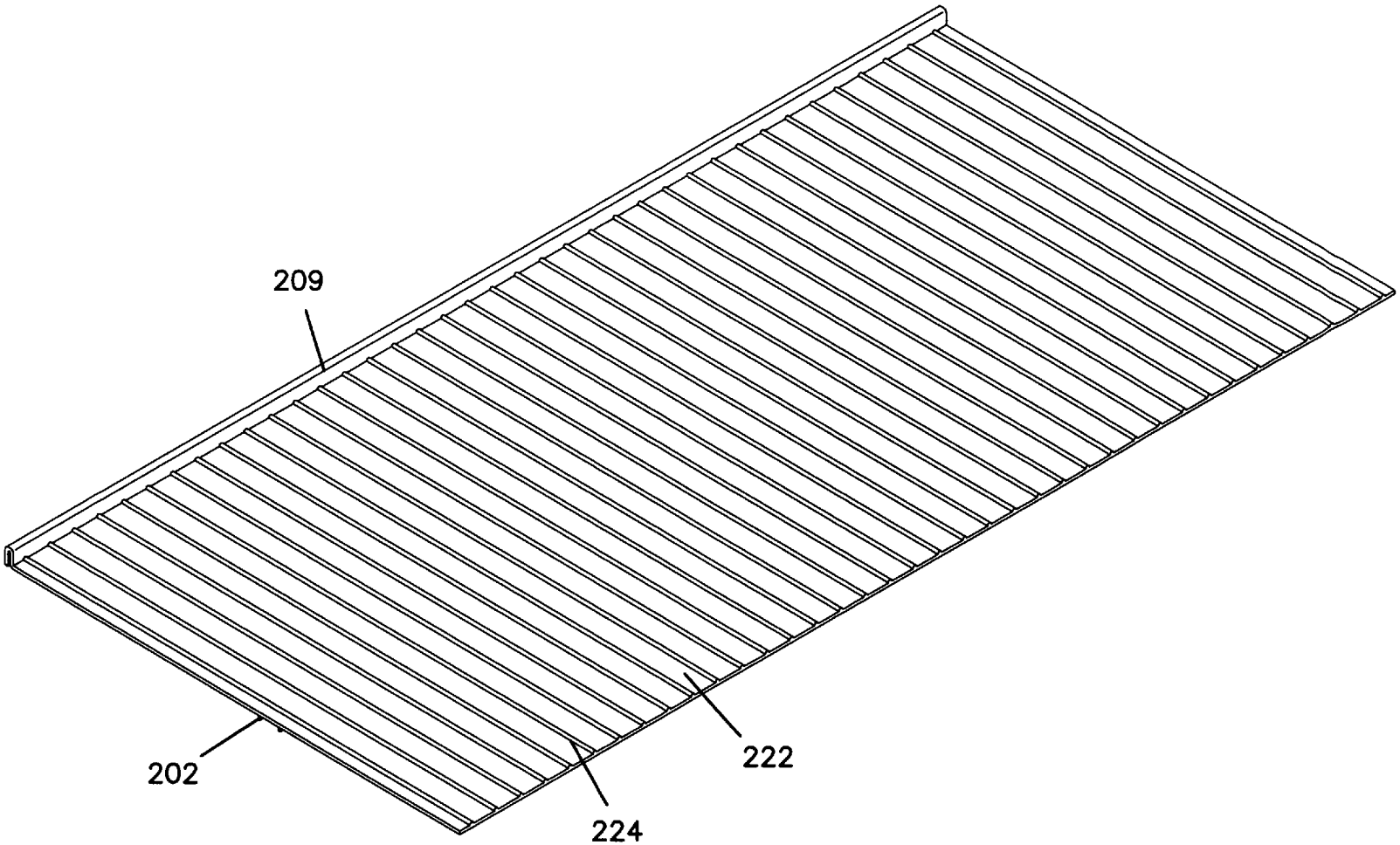
FIG. 19 is a (*a*) side perspective view, (*b*) side view, (*c*) underneath view of a fifth form of tray for use with the first embodiment.
Figure 19C:
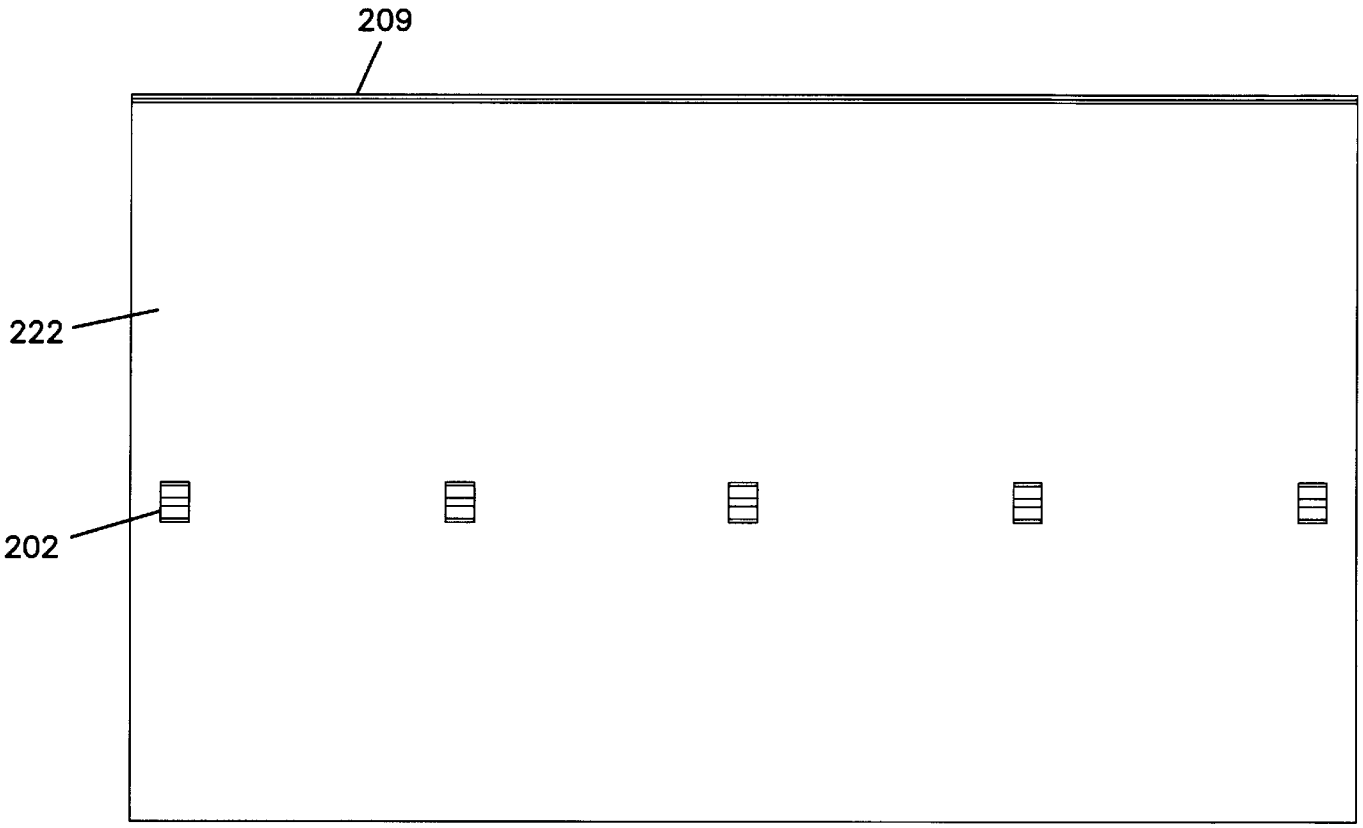
Figure 19B:
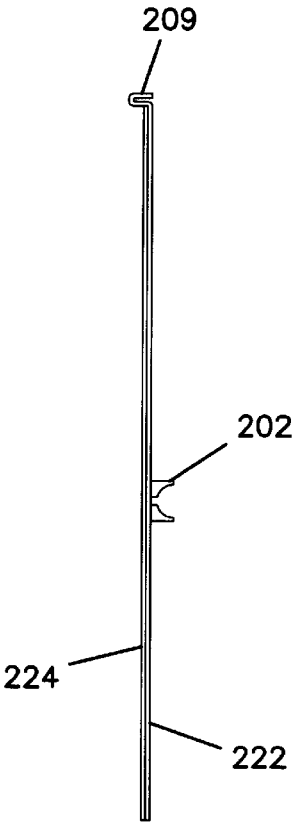

FIG. 19 shows a tray 222 being a variation of that of FIG. 16 in that longitudinally extending, upstanding ribs 224 are provided to assist product on tray 222 sliding towards the front thereof.

Figure 20A:
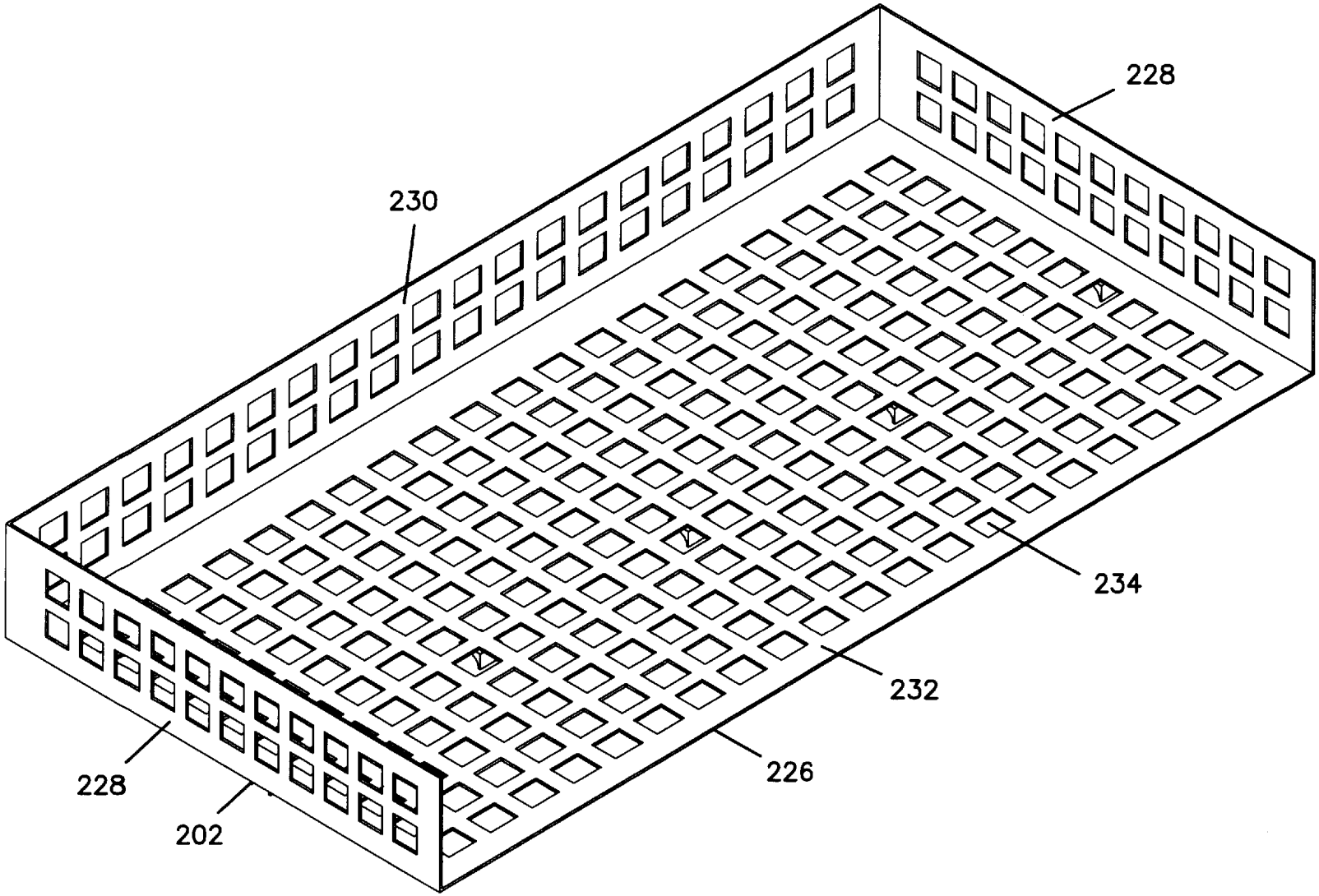
FIG. 20 is a (*a*) side perspective view, (*b*) side view, (*c*) underneath view of a basket for use with the first embodiment.
Figures 20B, 20C:
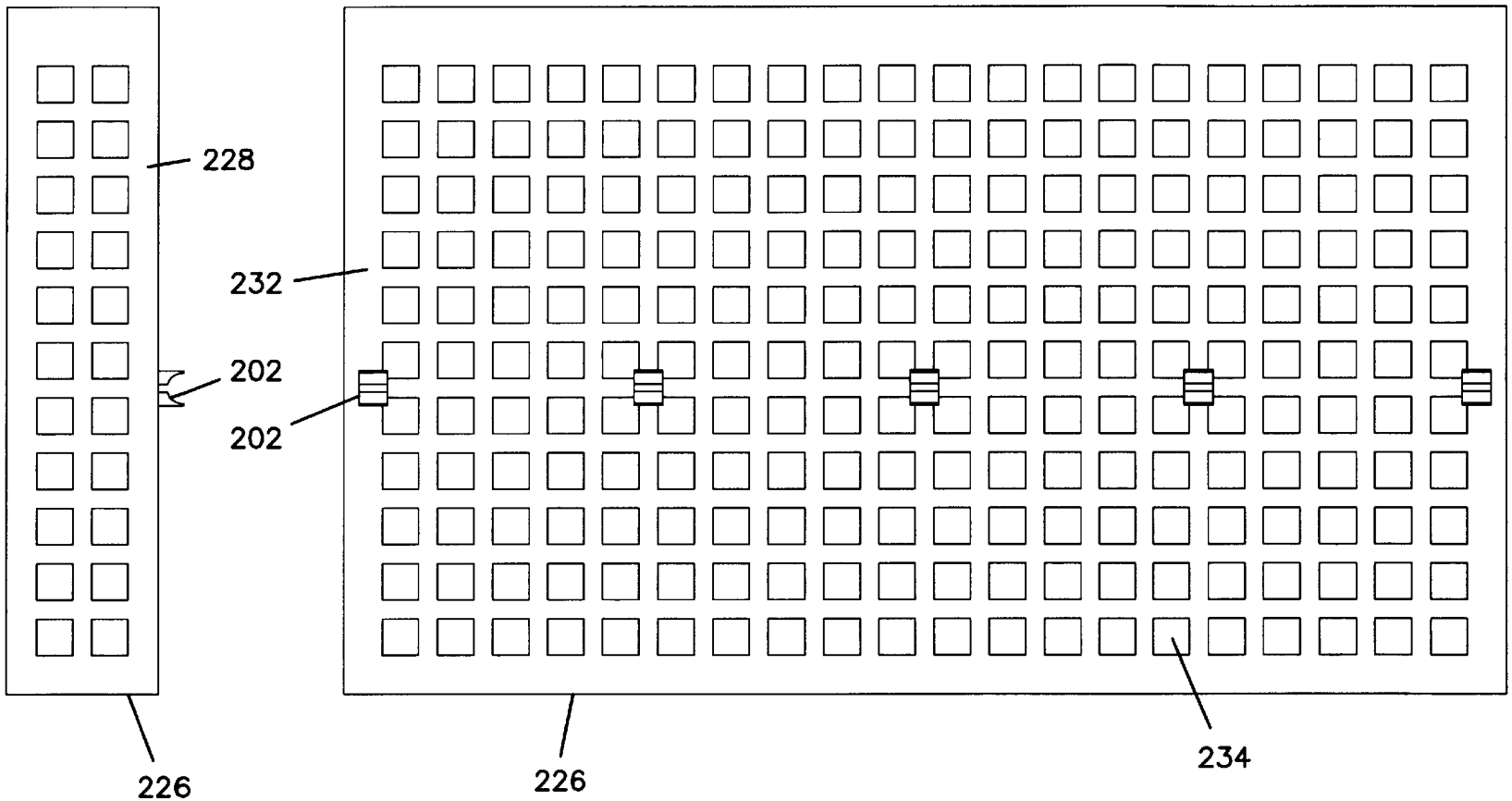
Figure 22:
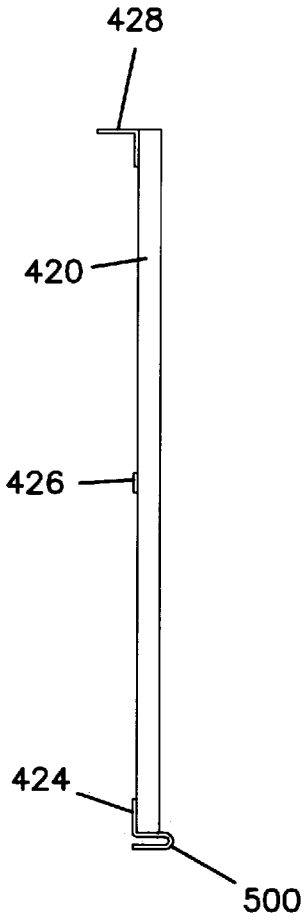
FIG. 22 is a side view of the fourth embodiment.
Figure 21:
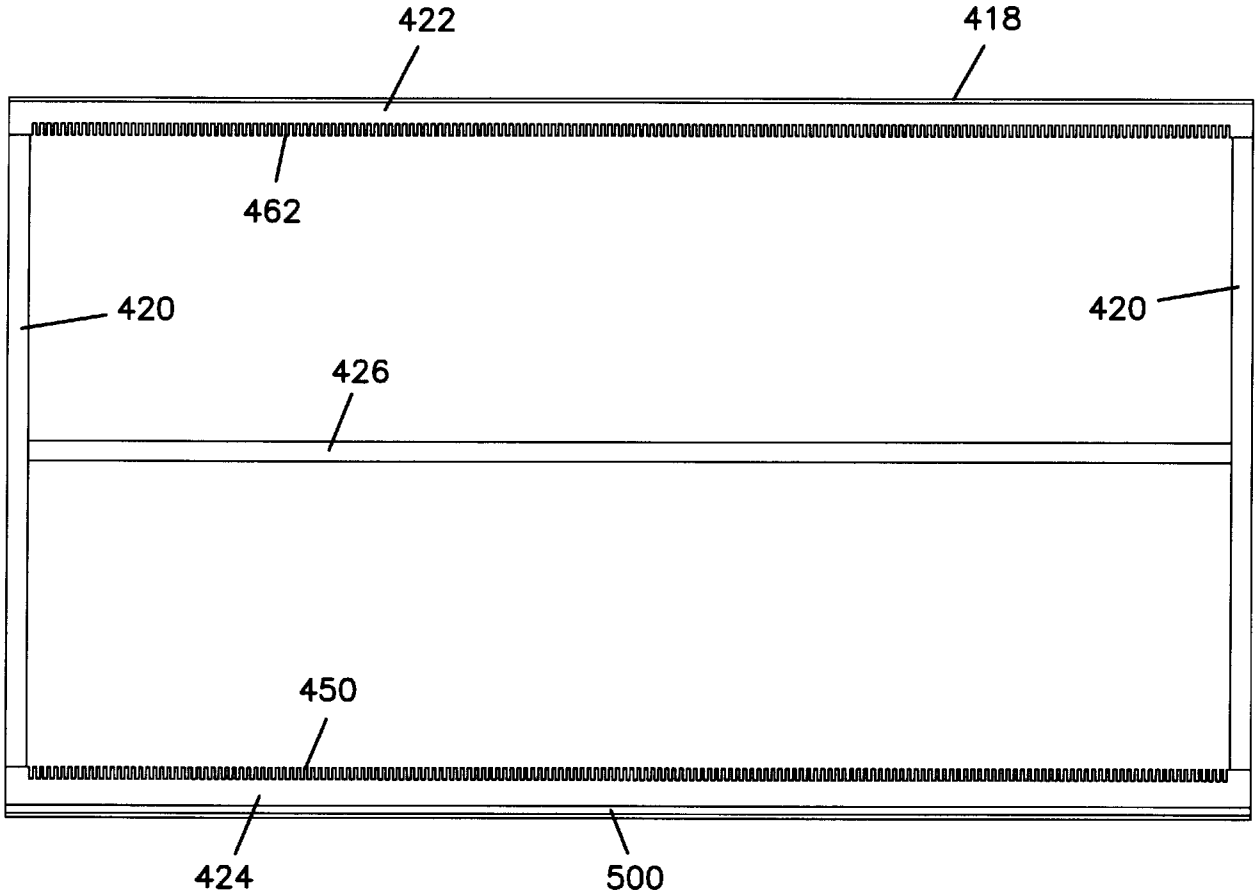
FIG. 21 is a top plan view of a fourth embodiment.

FIG. 20 shows a basket 226 which is similar to tray 210 except the sides 228, rear 230, and base 232 have a basket-like structure with a plurality of openings 234. The basket may be provided with a rear projection similar to projection 209 of FIGS. 15 to 19.

Any of the embodiments of FIGS. 15 to 20 may be used with or without an upstanding front projection 40, or front 25.

To refer now to FIGS. 21 to 35, where a fourth embodiment is illustrated, a preliminary reference numeral of 4 is used to indicate that the fourth embodiment is being referred to.

Here, there is shown a frame 418 which has two spaced apart sides 420, a rear member 422 and a front member 424. The front member 424 is substantially parallel to the rear member 422 and sides 420 are also substantially parallel. Sides 420 are perpendicular to rear member 422 and front member 424. A rod 426 intermediate the front member 424 and rear member 422 extends between the sides 420. The rod 426 is preferably rectangular and may be square. The rear member 422 may have a short, vertically upwardly extending extension 428. The front of rear member 422 has a plurality of grooves 462 which are formed integrally with the rear member 422.

Front member 424 has a plurality of grooves 450 formed in its rear face with the grooves being integral with the front member 424. Front member is also formed with a U-shaped slot 500 formed integrally therewith. However, for strengthening purposes, there may be an occasional rivet across slot 500.

Figure 23:
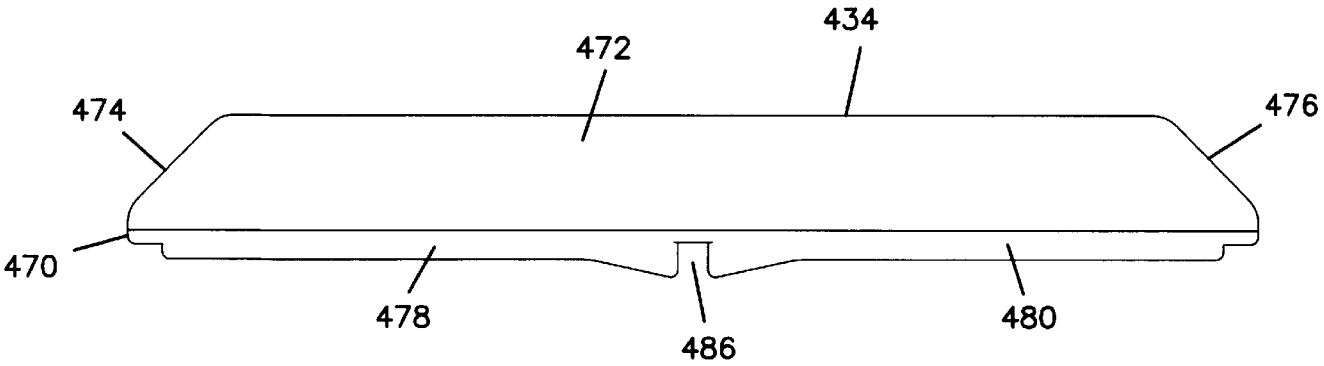
FIG. 23 is a side view of a product support for use with the fourth embodiment.
Figure 24:
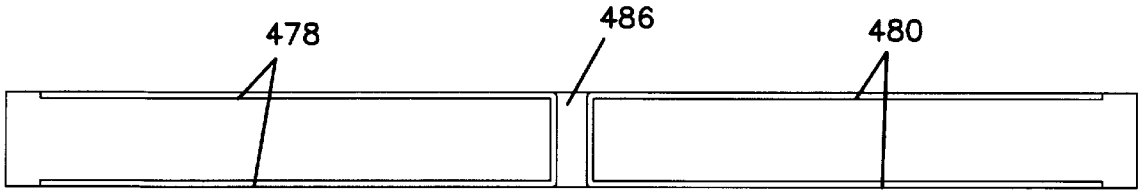
FIG. 24 is an underneath view of the product support of FIG. 23.
Figure 27:
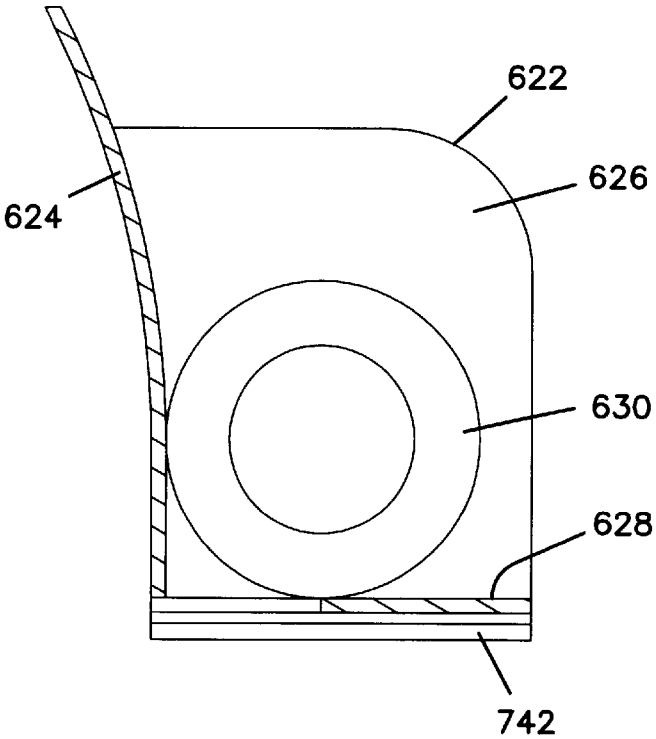
FIG. 27 is a vertical cross-sectional view of the slider of FIG. 26.
Figure 26:
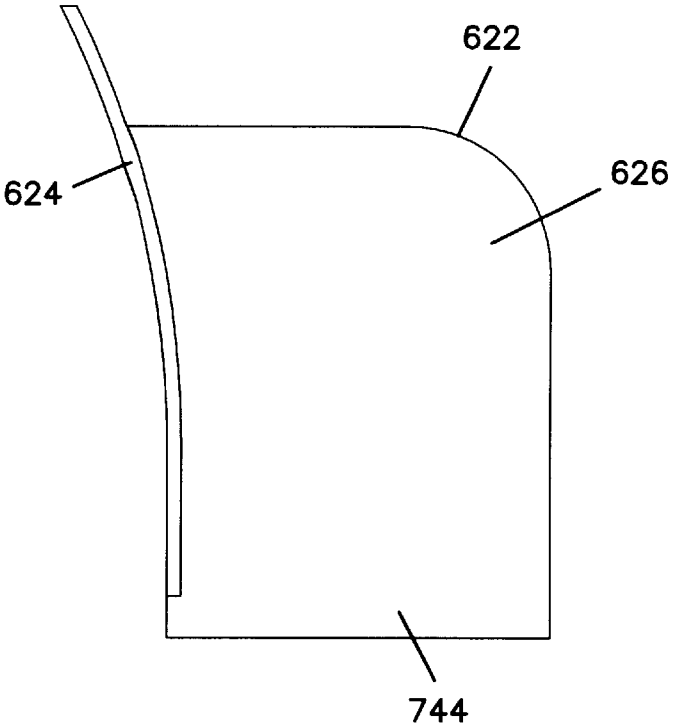
FIG. 26 is a side view of a slider for use with the fourth embodiment.
Figure 29:
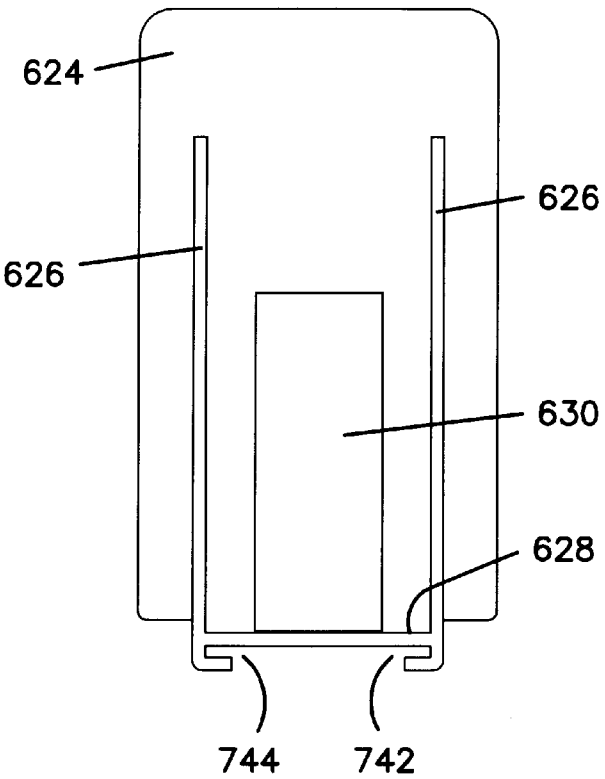
FIG. 29 is a rear view of the slider of FIGS. 26 to 28.
Figure 28:
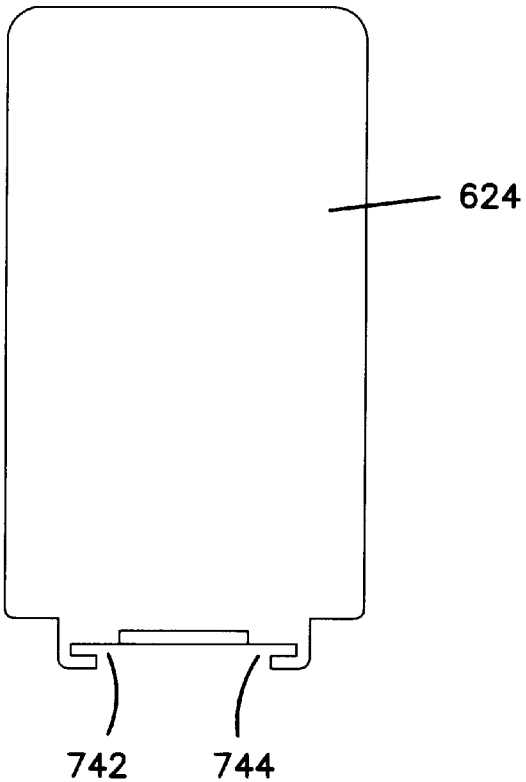
FIG. 28 is a front view of the slider of FIGS. 26 and 27.
Figure 31:
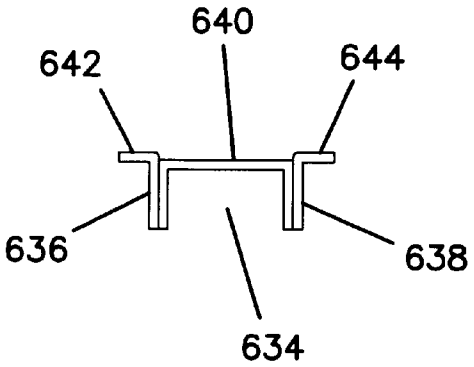
FIG. 31 is an end view of a rod for use with the sliders of FIGS. 28 to 30.

To refer now to FIGS. 23 and 24 there is shown a product support 434 which has a vertically extending web 472 and a shelf member 470. Shelf member 470 may have ribs 484, as in previous embodiments. It is to be noted here that the front 474 tapers, as does the rear 476. As is clear from FIG. 23, the product is symmetrical about its vertical axis and thus can be used in either direction. There is no "front" or "rear" to thus make it simpler to use.

The principal difference here is that the front rib 478 is formed has two depending skirts, one on, each side of the shelf member 470 and extending for substantially the length of the front half of the member 434. Identical depending skirts 480 are provided at the rear end.

The ribs 478, 480 increase in the height adjacent centre of member support 434, and have a channel 486 therethrough at the center. This forms the clip to engage on rod 426.

In this way, support member 434 can be moved vertically downwardly to engage in grooves 462, 450, and for channel 486 to engage over rod 426. The channel 486 is shown as square, although it may be round, ovular, elliptical, rectangular, or a polygonal shape.

Figure 34:
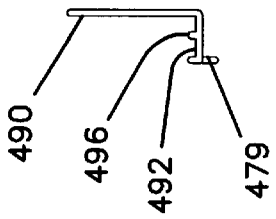
FIG. 34 is an end view of the product support of FIGS. 32 and 33.
Figure 32:
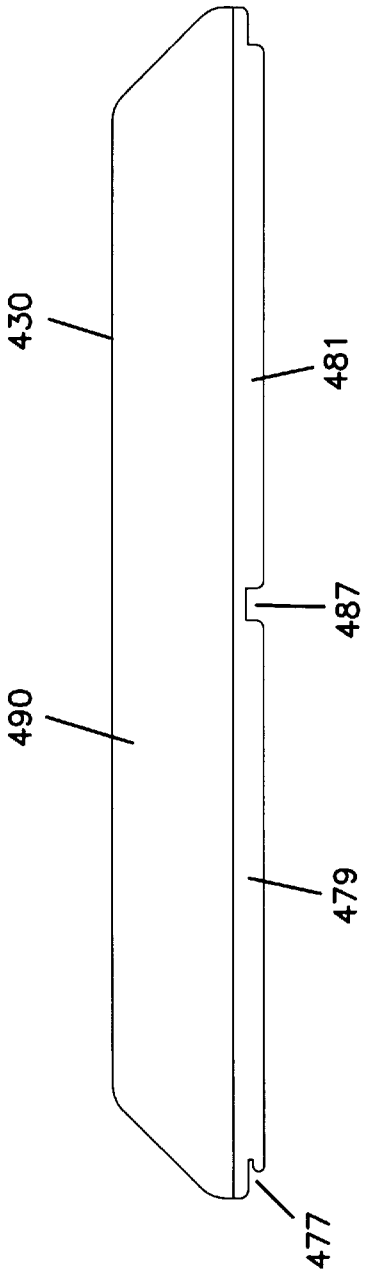
FIG. 32 is a side view of an end product support for use with the fourth embodiment.
Figure 33:
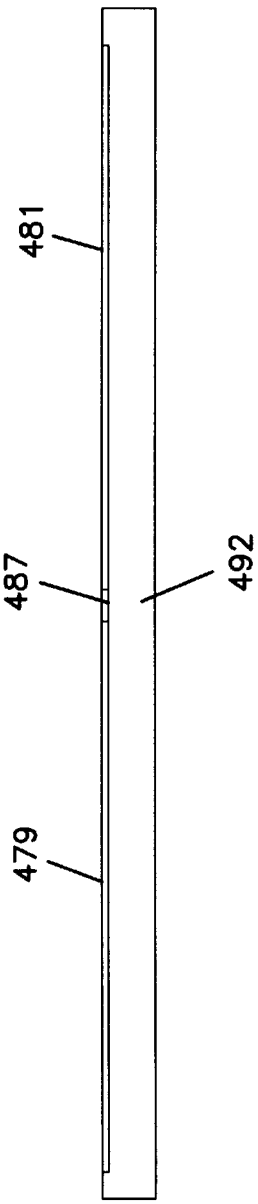
FIG. 33 is an underneath view of the product support of FIG. 32.

In FIGS. 32 to 34, there is shown the equivalent end product support 430. As is clear from FIG. 34, product support 430 is L shaped. It has a vertical web 490 and a horizontal shelf member 492 on only one side of web 490. Ribs 496 may be provided on shelf member 492.

Figure 25:
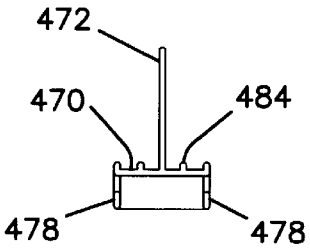
FIG. 25 is an end view of the product support of FIGS. 23 and 24.

The principal difference over the product support of FIGS. 23 to 25, is that the fins 479, 481 are of constant height throughout their length. The channel 487 is of reduced height. This is because of ease of insertion of product support 430. Rib 479 may have a small cut-out 477 at the front thereof. In this way, the product support 430 can engage on front member 424 or rear member 422 beyond the grooves 450, 462. As can be seen from FIG. 21, there is a non-groove portion at each end. To enable cut-out 477 to engage on either front member 424 or rear member 422, an angular movement is required and thus channel 487 is of reduced height.

Figure 35:
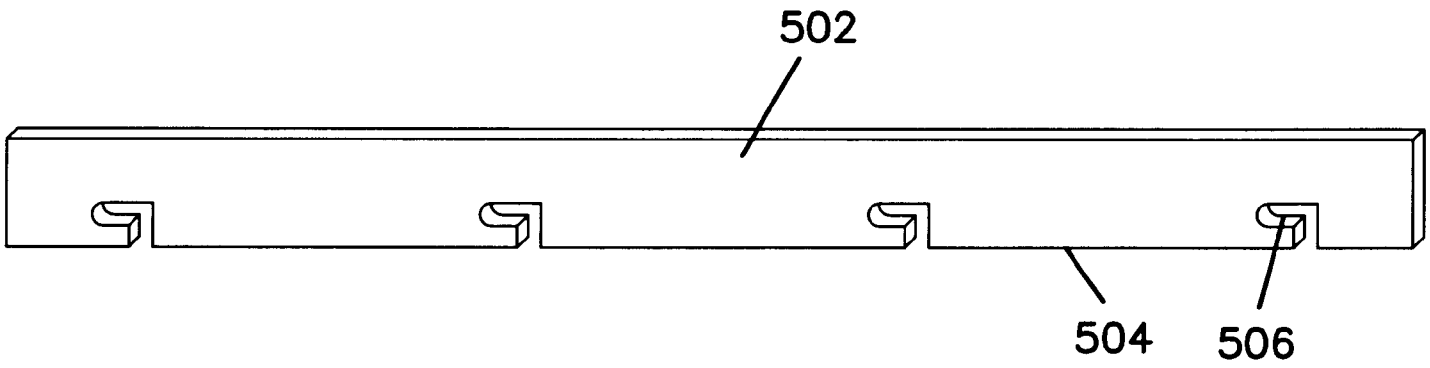
FIG. 35 is a front perspective view of a slotted barrier for use with the fourth embodiment.

In FIG. 35 there is illustrated a slotted barrier 502. This is intended to engage within elongate slot 500 of front member 424. As has been described, there may be rivets across elongate slot 500. The slotted barrier 502 has a lower surface 504 with a number of L-shaped cut-outs 506. In this way the barrier 502 can be lowered vertically into slot 500, and then moved along the axis of slot 500 so that the rivets engaged in the undercut portion of cut-outs 506. This would then locate the barrier 502 in position.

Preferably barrier 502 is made of a clear material such as perspex to enable the products on the product supports behind it to be seen.

Reference is now made to FIGS. 26 to 31, where there is shown an alternative form of rod designated as 634. This form of rod 634 has depending skirts 636, 638 which can engage in grooves 462, 450. They are joined by a web member 640. Extending outwardly are wings 642, 644 which engage in slots 742, 744 underneath a slider 622. Slider 622 has a front face 624 and side members 626. Mounted within slider 622, between side member 626 and on top of base 628, is a spring 630 which is in the form of a clock spring. By being attached to front member 450, but being located within slider 622, the clock spring will bias slider 622 towards front member 424.

Figure 30:
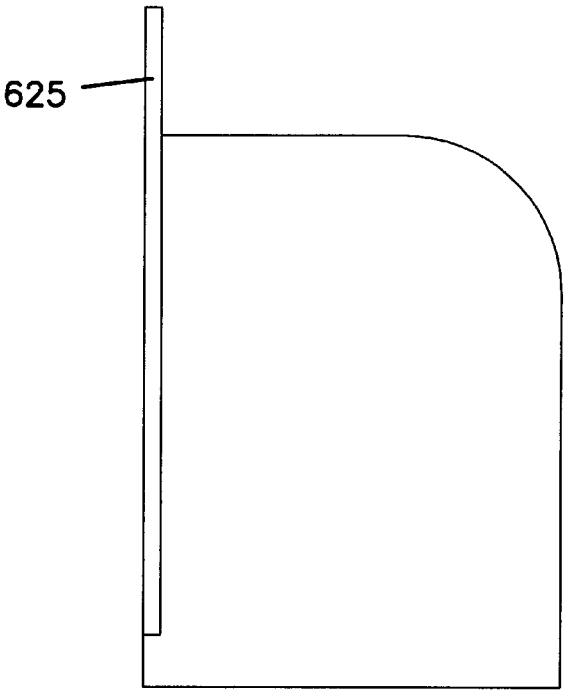
FIG. 30 is a side view of an alternative form of slider to that shown in FIGS. 26 to 29.

A variation is shown in FIG. 30 where the only difference is that the front face 625 is vertically oriented rather than curved as in FIGS. 26 to 29. In all other respects it is the same.

The operation of the slider 626 in conjunction with the rod 640 is the same, generally, as for organiser 122 and rod 134 of the first embodiment.

The various components of the shelving system described and illustrated may be made of any suitable material such as, for example, timber, plastics or metal; and by any suitable process such as, for example, forming, injection moulding, blow moulding, extruding, roll forming or pressing.

The size, number, spacing and location of the ribs in the product supports may be varied as required. They may be deleted if desired.

Whilst there has been described in the foregoing description preferred constructions of a shelving system incorporating the preferred features of the present invention, it will be understood by those skilled in the technology concerned that many variations or modifications in details of any design or construction may be made without departing from the present invention. For example, in place of grooves in the front and rear members, rods similar to rod 426 may be used, with similar engaging mechanisms. Frictional engagement of sufficient strength would ensure accurate and reliable location.

Also, the product supports may have transversely extending projections therefrom along their length on either or both sides and in the form of fingers and/or a panel to enable the gap between adjacent product supports to be occupied thereby. The fingers and/or panel of adjacent product supports may be able to slidingly engage with each other.

It will be understood that the invention disclosed and defined herein extends to all alternative combinations of two or more of the individual features mentioned or evident from the text or drawings. All of these different combinations constitute various alternative aspects of the invention.

It will also be understood that where the term "comprises" or its grammatical variants, is employed herein, it is equivalent to the term "includes" and is not to be taken as excluding the presence of other elements or features.

The claims defining the invention are as follows:

1. A shelving system including:

(a) a frame;

(b) the frame having a rear member, a front member spaced from the rear member, and at least one side joining the front member and the rear member;

(c) the rear member having a rear attachment portion, the rear attachment portion having a front face with a plurality of grooves therein, the rear member having a vertically upwardly extending extension;

(d) the front member having a front attachment portion, the front attachment portion having a rear face with a plurality of grooves therein, and a front member vertical extension located in a longitudinally extending U-shaped slot in the front member;

(e) at least two spaced apart product supports extending between and being supported by the rear member and the front member;

(f) the product supports each having at least one fin depending therefrom to engage in at least one of the grooves of the front attachment portion and rear attachment portion;

(g) the product supports each having a horizontal shelf member and a vertical web member, the horizontal shelf members of adjacent product supports being adapted to receive thereon at least one product to be displayed, the vertical web member being of reduced height at its front.

2. A shelving system as claimed in claim 1, wherein the product supports are spaced apart so that the horizontal shelf members of adjacent product supports do not contact each other, the product supports being parallel to each other.

3. A shelving system as claimed in claim 1, wherein the front member is substantially parallel to the rear member.

4. A shelving system as claimed in claim 1, wherein each product support has a vertically extending web, the vertically extending webs of adjacent product supports being spaced apart by a distance determined by the width of the product to be displayed.

5. A shelving system as claimed in claim 4, wherein at least one of the horizontal shelf member and the vertical web has a longitudinally extending raised rib thereon.

6. A shelving system as claimed in claim 4, wherein both the shelf member and the vertical web have at least one longitudinally extending rib.

7. A shelving system as claimed in claim 1, wherein the frame has a rod extending parallel to, but located between, the front member and the rear member.

8. A shelving system as claimed in claim 7, wherein the product support has depending therefrom a clip adapted to releasably engage the rod.

9. A shelving system as claimed in claim 8, wherein the product support has two fins depending therefrom, one at each end of the product support.

10. A shelving system as claimed in claim 8, wherein the product support has one fin extending for a substantial portion of the length of the product support.

11. A shelving system as claimed in claim 10, wherein the one fin incorporates the clip.

12. A shelving system as claimed in claim 1, wherein the product support is selected from the group consisting of inversely T-shaped, and L-shaped members.

13. A shelving system as claimed in claim 4, wherein the vertical web of the product support has a transverse member at its rear end to strengthen the web and/or to prevent product on the product support moving rearwardly past the transverse member.

14. A shelving system as claimed in claim 13, wherein a second transverse member is provided at the front of the product support.

15. A shelving system as claimed in claim 1, wherein the portion of reduced height tapers from a first height to a second height.

16. A shelving system as claimed in claim 1, wherein the front attachment portion and rear attachment portion are integral with the front member and rear member respectively.

17. A shelving system as claimed in claim 16, wherein the front attachment portion and rear attachment portion are separate components to the front and rear members respectively and are a front attachment member and rear attachment member.

18. A shelving system as claimed in claim 17, wherein the front attachment member is of a height such that it extends vertically upwardly beyond the front member.

19. A shelving system as claimed in claim 18, wherein that part of the front attachment member extending beyond the front member is transparent.

20. A shelving system as claimed in claim 18, wherein the rear attachment member is of a height such that it extends vertically upwardly beyond the rear member.

21. A shelving system as claimed in claim 18, wherein the product support has a slide, there being a slide rod extending from the front attachment member to the rear attachment member and passing through a rod aperture in the slide; there being a biasing means to bias the slide towards the front member.

22. A shelving system as claimed in claim 21, wherein the biasing means is a spring, preferably a clock spring, acting on the slide.

23. A shelving system as claimed in claim 21, wherein the slide has a body in which is located the rod aperture, and a product engaging member extending upwardly from the body.

24. A shelving system as claimed in claim 1, wherein the at least one fin is in the form of a skirt depending from the horizontal shelf member on either side of the horizontal shelf member, and extending for substantially the length of the front half of the horizontal shelf member, and for substantially the length of the rear half of the horizontal shelf member.

25. A shelving system as claimed in claim 1, wherein the vertical web is of reduced height at its rear.

26. A shelving system as claimed in claim 25, wherein the portion of reduced height at the rear tapers from a first height to a second height.

27. A shelving system as claimed in claim 1, wherein the frame is at an angle of approximately 15° to the horizontal, the rear member being higher.

28. A shelving system as claimed in claim 2, wherein there is a transverse channel between the skirts of the front half and the skirts of the rear half.

29. A shelving system as claimed in claim 3, wherein the skirts are of increased height adjacent the channel.

30. A shelving system as claimed in claim 3, wherein the frame has a rod extending parallel to, but located between, the front member and the rear member, the rod locating in the channel.

31. A shelving system as claimed in claim 12, wherein the inversely T-shaped product support is symmetrical about its vertical axis.

* * * * *